US007104230B2

(12) United States Patent
Fujii et al.

(10) Patent No.: US 7,104,230 B2
(45) Date of Patent: Sep. 12, 2006

(54) DRIVE OF VARIABLE VALVE LIFT MECHANISM

(75) Inventors: Noriaki Fujii, Wako (JP); Hisao Sakai, Wako (JP); Tadaharu Shoji, Wako (JP); Motohiro Maruyama, Wako (JP); Tomoya Fujimoto, Wako (JP); Akiyuki Yonekawa, Wako (JP); Takahumi Mizorogi, Wako (JP); Keiko Yoshida, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/019,673

(22) Filed: Dec. 23, 2004

(65) Prior Publication Data

US 2005/0161011 A1 Jul. 28, 2005

(30) Foreign Application Priority Data

Dec. 24, 2003 (JP) ..... 2003-426070
Feb. 25, 2004 (JP) ..... 2004-049347

(51) Int. Cl.
*F01L 1/34* (2006.01)

(52) U.S. Cl. ..... 123/90.16; 123/90.15; 123/90.31

(58) Field of Classification Search ..... 123/90.15, 123/90.16, 90.31
See application file for complete search history.

(56) References Cited

U.S. PATENT DOCUMENTS 4,329,887 A * 5/1982 Kawamoto ..... 74/467
5,301,639 A 4/1994 Satou ..... 123/90.17
5,365,898 A 11/1994 Mueller ..... 123/90.17
5,680,837 A * 10/1997 Pierik ..... 123/90.17
6,019,076 A 2/2000 Pierik et al. ..... 123/90.16
6,202,611 B1 3/2001 Regueiro ..... 123/90.17
6,615,775 B1 * 9/2003 Takemura et al. ..... 123/90.15

FOREIGN PATENT DOCUMENTS

DE 101 20 451 10/2002
JP 60147581 A * 8/1985
JP 2002-364317 12/2002
WO WO 2004/109066 12/2004

OTHER PUBLICATIONS

Patent Abstracts of Japan; vol. 2000, No. 16, May 8, 2001 & JP 2001 003720 A (Unisia Jecs Corp; Nissan Motor Co Ltd), Jan 9, 2001 *Abstract*.
Patent Abstracts of Japan; vol. 2003, No. 04, Apr. 2, 2003 & JP 2002 364317 A (Honda Motor Co Ltd), Dec. 18, 2002 * the whole document* .
European Search Report dated Apr. 8, 2005.

* cited by examiner

*Primary Examiner*—Thomas Denion
*Assistant Examiner*—Zelalem Eshete
(74) *Attorney, Agent, or Firm*—Armstrong, Kratz, Quintos, Hanson & Brooks, LLP

(57) ABSTRACT

A drive of a variable valve lift mechanism for driving a control shaft controlling a variable valve lift mechanism provided between an engine valve and an engine valve operating cam in order to change lift amount of the engine valve, comprises: a rotational force generating actuator; power conversion means for converting a rotational force of the rotational force generating actuator into a pivoting force of the control shaft; and a casing containing the power conversion means with the rotational force generating actuator coupled to an outer face of the casing. One end of the control shaft protrudes outward from one side of an engine body. The casing into which one end of the control shaft is inserted is attached to the one side of the engine body through fixing means which can be repeatedly attached and detached. Thus, it is possible to avoid the engine body from being complex and improve maintainability.

7 Claims, 16 Drawing Sheets

DRIVE OF VARIABLE VALVE LIFT MECHANISM

RELATED APPLICATION DATA

The Japanese priority application Nos. 2003-426070 and 2003-49347 upon which the present application is based are hereby incorporated in their entirety herein by reference.

BACKGROUND OF THE INVENTION

1. Field of the Invention

The present invention relates to a drive of a variable valve lift mechanism for driving a control shaft controlling a variable valve lift mechanism provided between an engine valve and an engine valve operating cam in order to change the amount of lift of the engine valve.

2. Description of the Related Art

In Japanese Patent Application Laid-open No. 2002-364317, the present applicant already proposed a valve operating system of an internal combustion engine having a variable valve lift mechanism for continuously varying the amount of lift (valve opening degree) of an intake valve serving as an engine valve. This engine valve operating system is constituted so as to rotation-drive a sector-shaped worm wheel by a worm rotation-driven by, for example, a motor; pivot a lever directly connected to the worm wheel; and change the transmission rate of a cam lift to the intake valve. Driving mechanisms, such as a worm and a worm wheel, are directly built in a cylinder head or cylinder block.

However, using a configuration in which the main part of a driving mechanism is built in an engine body leads to disadvantages that not only the structure of the engine becomes complex but also the engine body need to be inevitably disassembled to a certain extent for maintenance of the driving mechanism.

SUMMARY OF THE INVENTION

The present invention has been achieved in view of the above situation, and has an object to provide a drive of a variable valve lift mechanism for preventing an engine body from being complex and improving the maintainability.

According to a first feature of the present invention, there is provided a drive of a variable valve lift mechanism for driving a control shaft controlling a variable valve lift mechanism provided between an engine valve and an engine valve operating cam in order to change lift amount of the engine valve, comprising: a rotational force generating actuator; power conversion means for converting a rotational force of the rotational force generating actuator into a pivoting force of the control shaft; and a casing containing the power conversion means with the rotational force generating actuator coupled to an outer face of the casing, wherein one end of the control shaft protrudes outward from one side of an engine body, and wherein the casing into which one end of the control shaft is inserted is attached to the one side of the engine body through fixing means which can be repeatedly attached and detached.

With the arrangement of the first feature, an independently constituted drive is attached to the outside of the engine body. Therefore, the engine body does not become complex. Also, the drive can be singly attached to and detached from the engine body, to thereby contribute to improvement of maintainability.

According to a second feature of the present invention, in addition to the arrangement of the first feature, an oil reservoir surrounding the control shaft is formed on a cylinder head constituting a part of the engine body; and an oil path whose one end opens at a portion immersed in the oil of the control shaft is provided on the control shaft so as to lead lubricating oil into the casing.

When attaching the independently-constituted drive to the engine body, it is generally preferred to form an oil path concavely in the mating faces between a cylinder head and a drive in order to supply lubricating oil, or to form an exclusive oil path in the cylinder head by casting-out or machining. However, these techniques have difficulty in the process for forming the oil path, and it is necessary to increase the capacity of an oil pump corresponding to increase of oil quantity. Moreover, increase of the pump friction due to increase of the back pressure of a lubricating oil supply path results in output loss of the engine. However, according to the second feature, the lubricating oil splashed into the head cover or the oil leaking from the bearing portion of the cam shaft are stored in the oil reservoir, and then supplied to the drive side by gravitation. Therefore, additional energy is unnecessary for supply of oil, and thus power loss due to the additional energy does not occur. Moreover, it is only necessary to form an oil reservoir at a part of the cam holder, and an oil path can be formed by comparatively simple drilling. Thus, it is possible to minimize increase of the manufacturing cost.

According to a third feature of the present invention, in addition to the arrangement of the first feature, the rotational force generating actuator has an output shaft whose axis is provided on a plane orthogonal to an axis of the control shaft, and is attached to an outer face of the casing; and the power conversion means is housed in the casing, and includes a screw shaft having an axis parallel with the output shaft and a reduction gear mechanism provided between the screw shaft and the output shaft.

With this third feature, the axis of the output shaft of the rotational force generating actuator is disposed on the plane orthogonal to the axis of the control shaft, and attached to the outer face of the casing. Therefore, it is possible to suppress the amount of protrusion of the rotational force generating actuator and the casing out of the engine body in the direction along the axis of the control shaft; make compact the whole structure including the rotational force generating actuator and the casing in the axial direction of the control shaft; and prevent the size of an engine from increasing. Moreover, the rotational force output from the output shaft of the rotational force generating actuator is transferred to the screw shaft through the reduction gear mechanism. Therefore, it is possible to decrease the size of the rotational force generating actuator to make the actuator more compact.

According to a fourth feature of the present invention, in addition to the arrangement of the first feature, a positioning section is integrally provided in a holder attached to the engine body to rotatably support at least a part of a circumference of the one end of the control shaft, and has a portion surrounding the control shaft and protruding out of a sidewall of the engine body; and the casing is attached to an outer face of the sidewall of the engine body, and includes a fitting hole for receiving the portion of the positioning section protruding out of the sidewall of the engine body.

With this fourth feature, when attaching the casing to the outer face of the sidewall of the engine body, it is possible to easily improve accuracy in the connection between the control shaft in which at least a part of the circumference of the holder is rotatably supported and the power conversion means in the casing, by fitting the positioning section of the holder to the fitting hole of the casing of the engine body; and it is possible to attach the casing to the outer face of the sidewall of the engine body while accuracy in the connection between the control shaft and the power conversion means is improved, by providing a slight allowance for the setting position of the casing to the outer face of the sidewall of the engine body.

According to a fifth feature of the present invention, in addition to the arrangement of the fourth feature, the holder is attached to a cylinder head constituting a part of the engine body in cooperation with a head cover; and the positioning section is held between mating faces of the cylinder head and the head cover. With this configuration, the control shaft is disposed at a lower position, to thereby make compact a mechanism for changing operation characteristics of the engine valve and contribute to downsizing of the engine.

According to a sixth feature of the present invention, in addition to the arrangement of the third feature, a sensor is coaxially arranged on the control shaft so as to detect pivoting amount of the control shaft, and is attached to a wall portion of the casing opposite to the one end of the control shaft. With this arrangement, it is possible to accurately detect the rotation amount of the control shaft by setting a sensor so as to coaxially face an end of the control shaft. Even if setting the sensor in this way, it is possible to make compact the whole structure including the rotational force generating actuator, casing, and sensor in the axial direction of the control shaft, thereby suppressing the increase of the size of the engine.

The above and other purposes and features and advantages of the present invention will be clarified from the description of preferred embodiments described below in detail along the accompanying drawings.

BRIEF DESCRIPTION OF THE DRAWINGS

FIG. 1 is a local longitudinal sectional view of an engine, which is a sectional view taken along the line 1—1 in FIG. 2.

FIG. 2 is a sectional view taken along the line 2—2 in FIG. 1.

FIG. 3 is a sectional view taken along the line 3—3 in FIG. 2.

FIG. 4 is an enlarged view of an essential portion in FIG. 1.

FIG. 5 is a bottom view of an intake-side locker arm viewed from the direction 5 in FIG. 4.

FIG. 6 is a sectional view taken along the line 6—6 in FIG. 4.

FIG. 7 is a longitudinal enlarged view of an essential portion of a locker arm showing a connection state between an adjust bolt and a tappet member.

FIG. 8 is a perspective view showing a relationship between an adjust bolt, a tappet member, and a locker arm.

FIG. 9 is a perspective view of a variable lift mechanism.

FIG. 10 is a sectional view taken along the line 10—10 in FIG. 4.

FIG. 11 is a sectional view taken along the line 11—11 in FIG. 2.

FIG. 12 is a sectional view taken along the line 12—12 in FIG. 2.

FIG. 13 is a perspective view showing apart of power conversion means.

FIG. 14 is a sectional view corresponding to FIG. 12 for showing a structure for driving a control shaft.

FIG. 15 is a sectional view taken along the line 15—15 in FIG. 14.

FIG. 16 is a sectional view taken along the line 16—16 in FIG. 14.

DESCRIPTION OF THE PREFERRED EMBODIMENT

Figure 1:
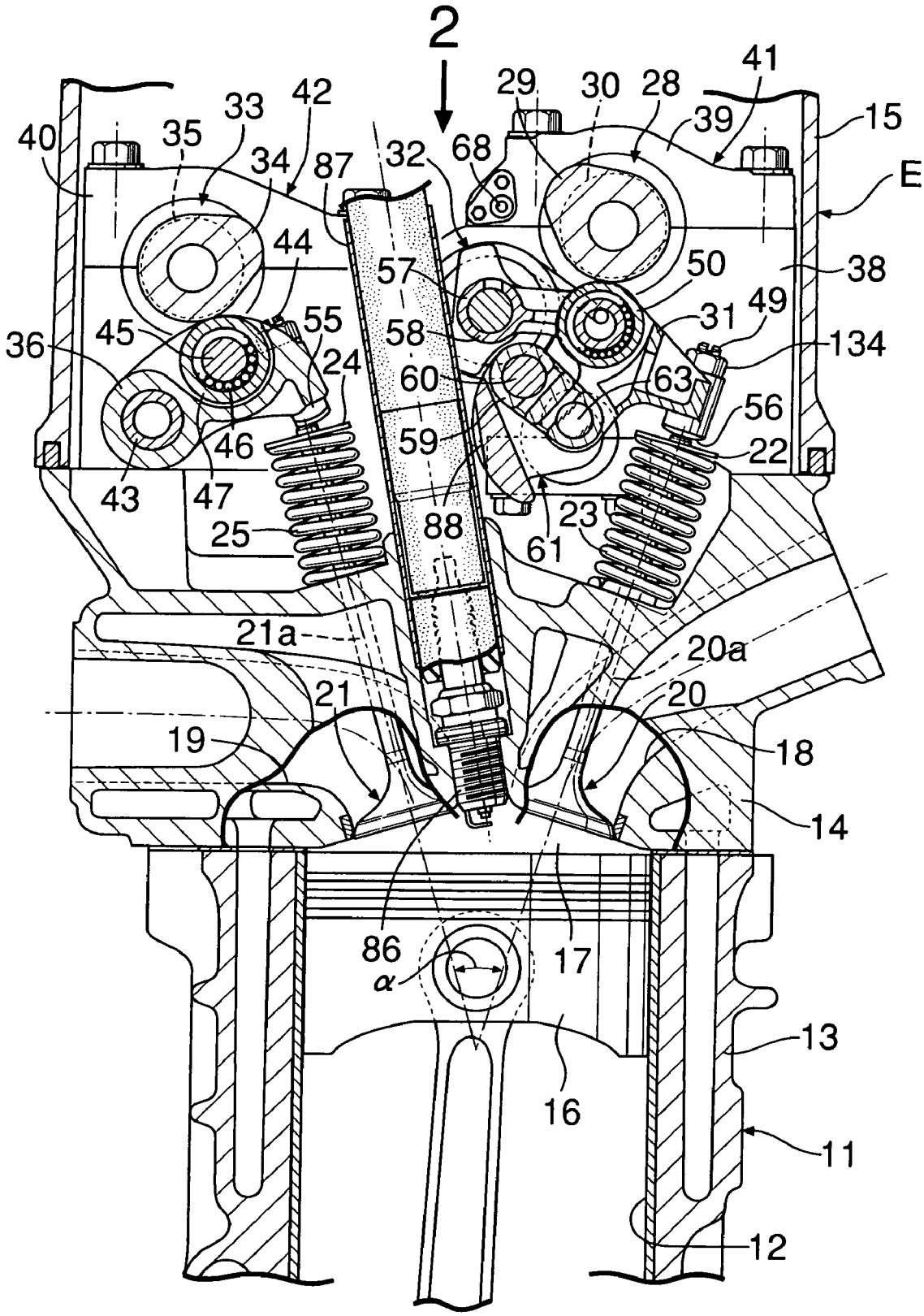
FIGS. 1 to 13 show a first embodiment of the present invention.

First, in FIG. 1, an engine body 11 of an in-line multi-cylinder internal combustion engine E includes a cylinder block 13 provided with cylinder bores 12 inside, a cylinder head 14 joined to a top face of the cylinder block 13 and a head cover 15 joined to a top face of the cylinder head 14. Pistons 16 are slidably fitted into the respective cylinder bores 12, and combustion chambers 17 . . . to which top portions of the respective pistons 16 . . . are faced are formed between the cylinder block 13 and the cylinder head 14.

The cylinder head 14 is provided with intake ports 18 . . . and exhaust ports 19 . . . communicable with the respective combustion chambers 17 . . . . Each of the intake ports 18 . . . is opened and closed by intake valves 20 . . . which are a pair of engine valves, and each exhaust port 19 is opened and closed by a pair of exhaust valves 21 . . . . A valve spring 23 which biases each of the intake valves 20 . . . in a valve closing direction is provided between a spring sheet 22 provided at an upper end portion of a stem 20*a* included by the intake valve 20 and the cylinder head 14. A valve spring 25 which biases each of the exhaust valves 21 . . . in the valve closing direction is provided between a spring sheet 24 provided at an upper end portion of a stem 21*a* included by the exhaust valve 21 and the cylinder head 14.

An intake-side valve operating system 28 for driving each of the intake valves 20 . . . to open and close each intake valve 20 is constructed in accordance with the present invention, and includes an intake-side camshaft 30 having an intake-side valve operating cam 29 for each cylinder, and an intake-side rocker arm 31 which is driven by the intake-side valve operating cam 29 to swing and commonly linked and connected to a pair of intake valves 20 . . . for each cylinder, and a variable valve lift device 32 which can change the valve-opening lift amount among the operation characteristics of the intake valves 20 for each cylinder, and an exhaust-side valve operating system 33 for driving the exhaust valves 21 . . . to open and close includes an exhaust-side camshaft 35 having an exhaust-side valve operating cam 34 for each cylinder, and an exhaust-side rocker arm 36 which is driven by the exhaust-side valve operating cam 34 to swing and commonly linked and connected to a pair of exhaust valves 21 . . . for each cylinder.

Figure 2:
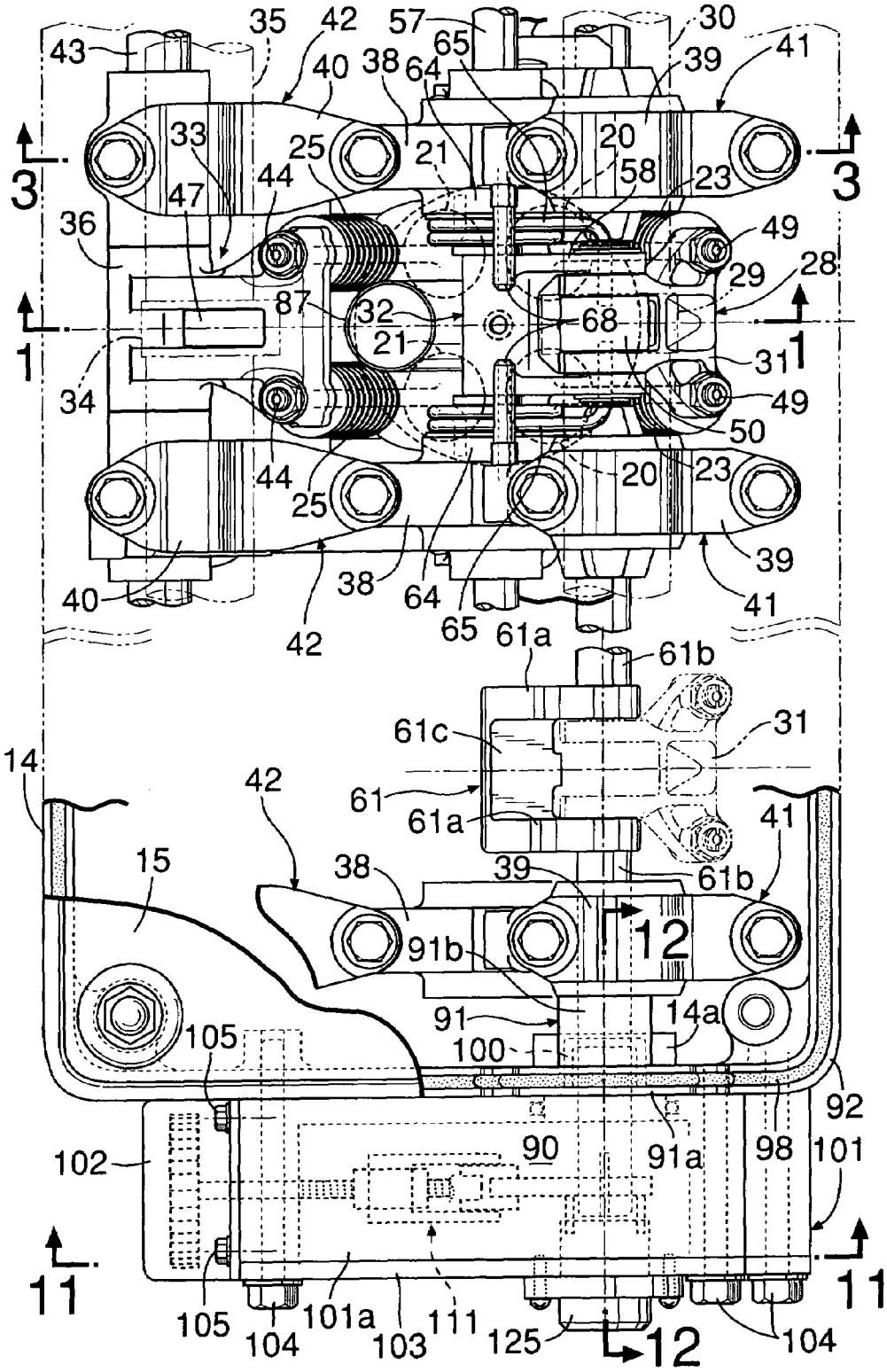
Figure 3:
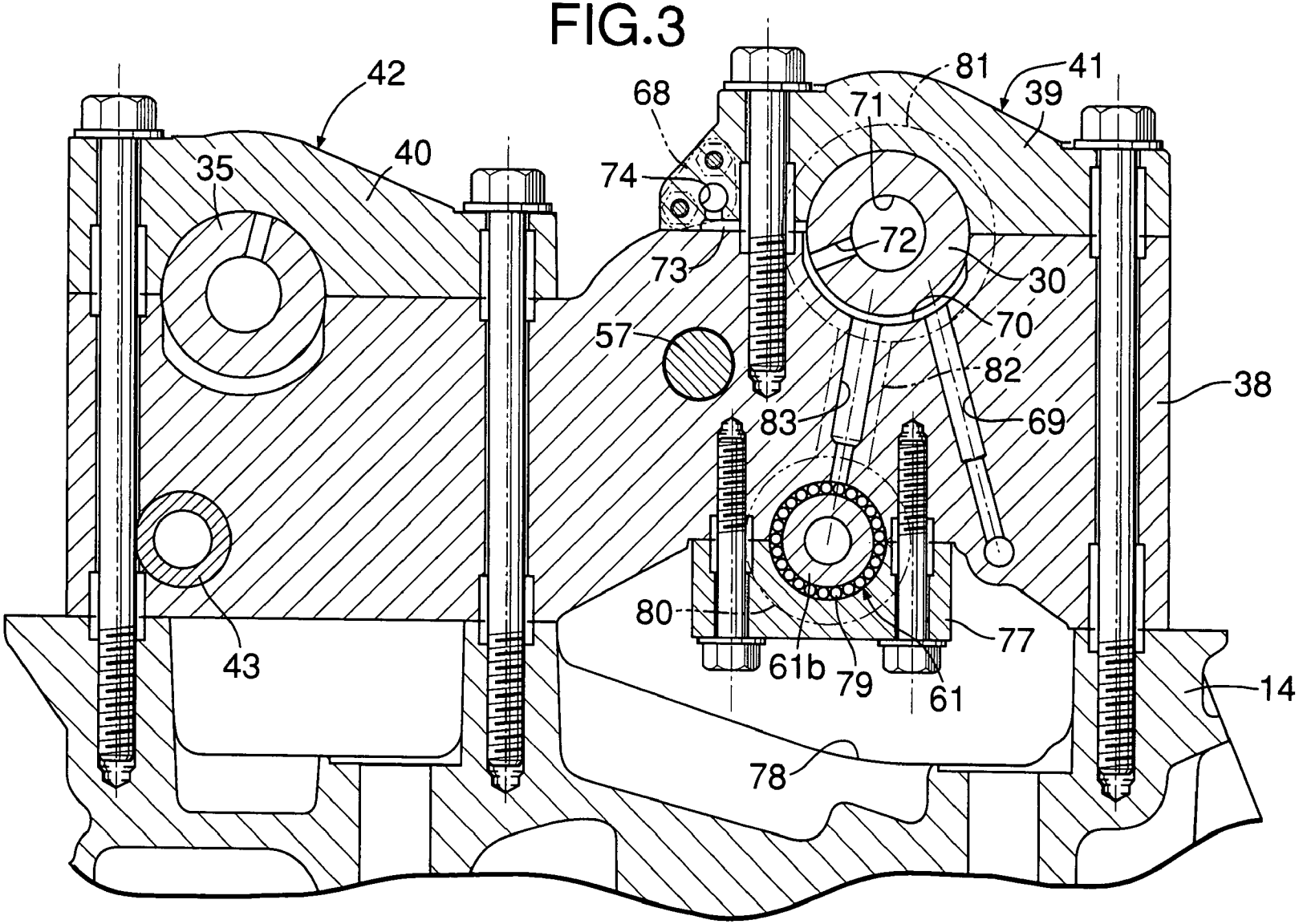

With reference to FIG. 2 and FIG. 3 in combination, upper holders 38 . . . are fastened to the cylinder head 14 so as to be disposed at opposite sides of each cylinder. Caps 39 . . . and 40 . . . which cooperate to construct intake-side cam holders 41 . . . and exhaust-side cam holders 42 . . . are fastened to the respective upper holders 38 . . . from above. Thus, the intake-side camshaft 30 is rotatably supported between the upper holders 38 . . . and the cap 39 constituting the intake-side cam holders 41 . . . , and the exhaust-side camshaft 35 is rotatably supported between the upper holders 38 . . . and the caps 40 . . . which cooperate to construct the exhaust-side cam holders 42 . . . .

One end portion of the exhaust-side rocker arm 36 is swingably supported by an exhaust-side rocker shaft 43 having a parallel axis line with the exhaust-side camshaft 35 and supported by the upper holder 38. The other end portion of the exhaust-side rocker arm 36 abuts to upper ends of the stems 21*a* . . . in a pair of exhaust valves 21 . . . via a pair of tappet members 55 and 55. A shaft 45 which is parallel with the exhaust-side rocker shaft 43 is provided in an intermediate portion of the exhaust-side rocker arm 36, and a roller 47 in rolling contact with the exhaust-side valve operating cam 34 is pivotally supported by the exhaust-side rocker arm 36 with a roller bearing 46 interposed between the shaft 45 and the roller 47.

Such an exhaust-side valve operating system 33 is placed at the cylinder head 14 so that the swing support part of the exhaust-side rocker arm 36, namely, the exhaust-side rocker shaft 43 is disposed outside from the linking and connecting part of the exhaust-side rocker arm 36 to the exhaust valves 21 . . . , namely, the tappet members 55. . . .

Figure 4:
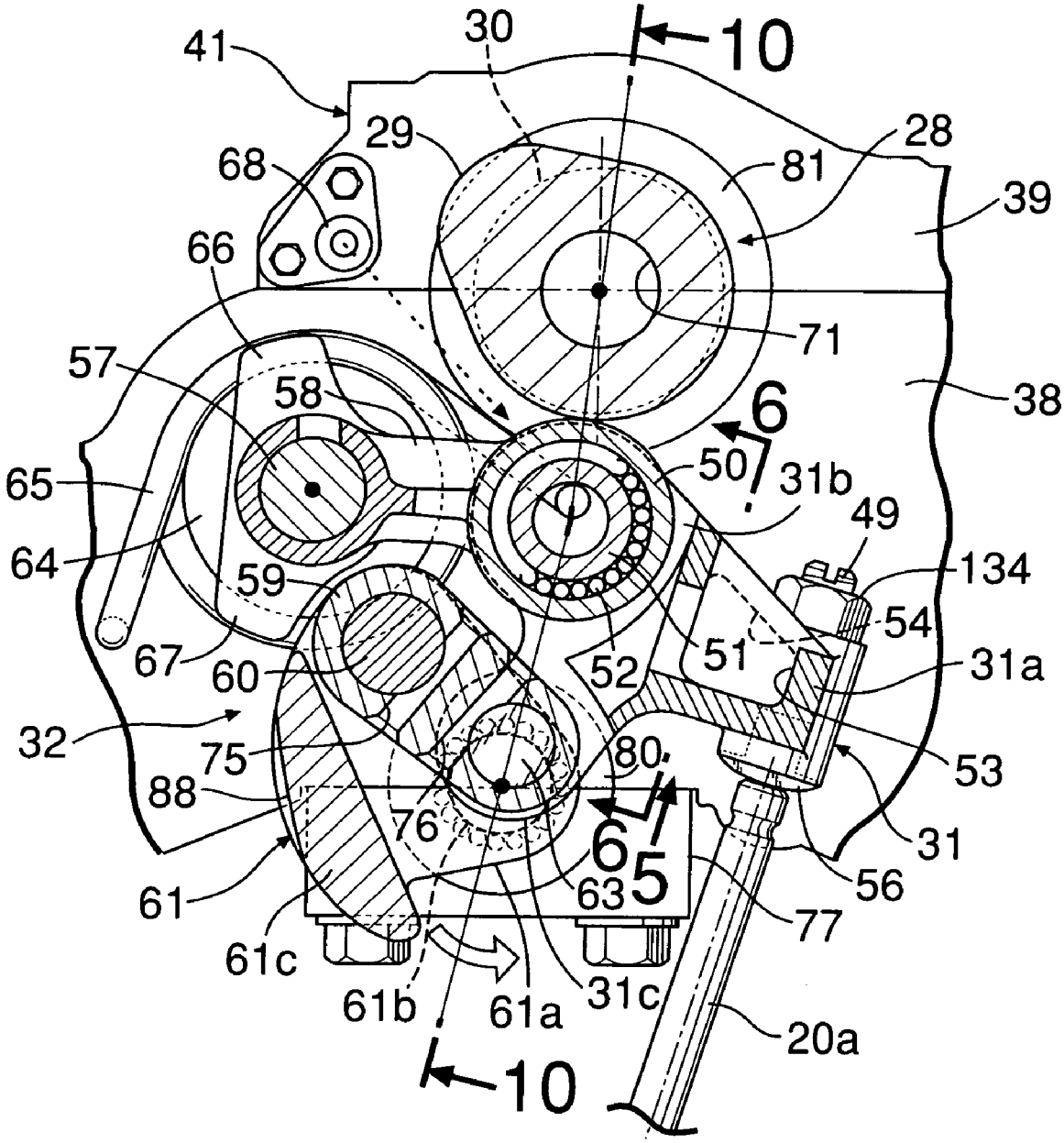
Figure 5:
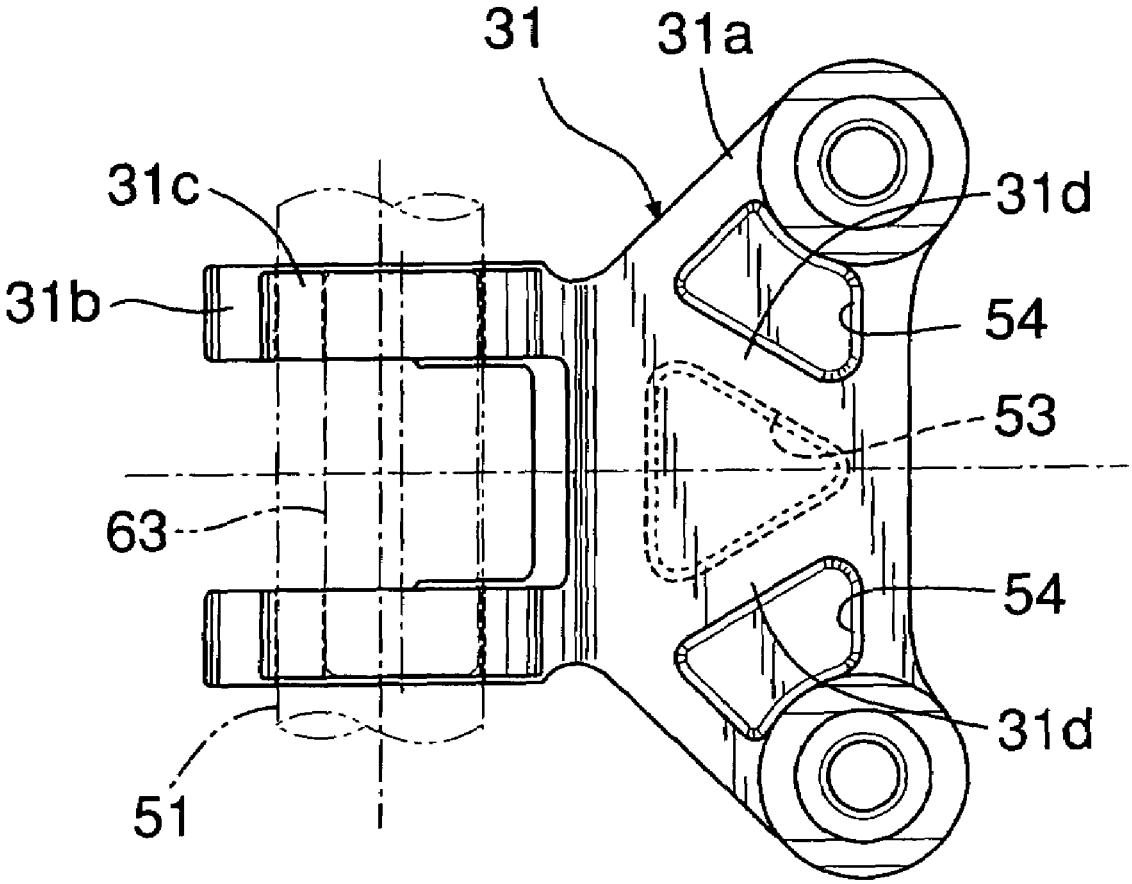

In FIG. 4 and FIG. 5, a valve connecting portion 31*a* provided on one end of the intake-side rocker arm 31 abut to upper ends of the stems 20*a* . . . in a pair of intake valves 20 . . . via a pair of tappet members 56 and 56. A first support part 31*b* and a second support part 31*c* disposed under the first support part 31*b* are provided at the other end portion of the intake-side rocker arm 31 to connect to each other, and the first and second support parts 31*b* and 31*c* are each formed into a substantially U-shape opened to an opposite side from the intake valves 20 . . . .

A roller 50 which is in rolling contact with the intake-side valve operating cam 29 of the intake-side camshaft 30 is pivotally supported at the first support part 31*b* of the intake-side rocker arm 31 via a first connecting shaft 51 and a roller bearing 52, and the roller 50 is disposed to be caught in the first support part 31*b* which is in the substantially U-shape.

Figure 6:
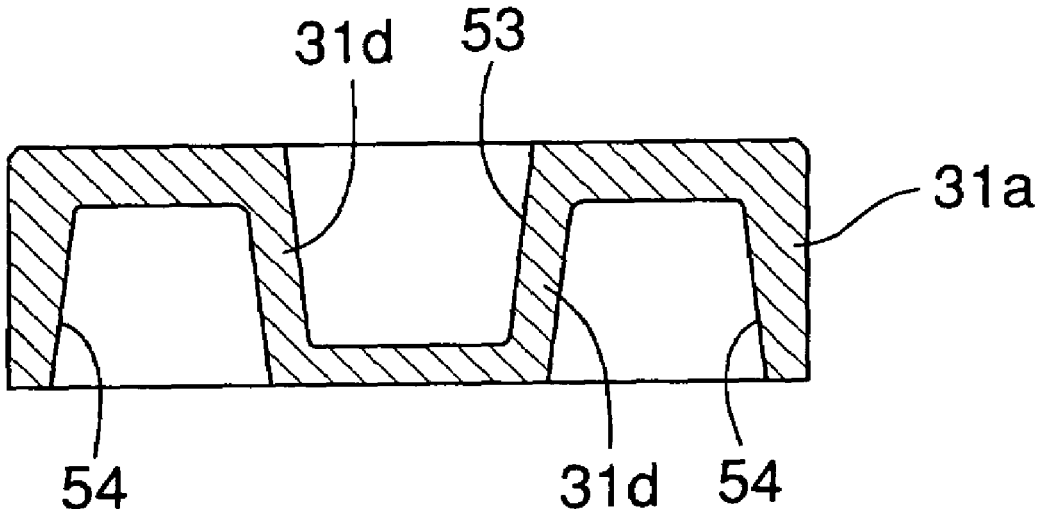

Referring also to FIG. 6, the intake-side rocker arm 31 is formed by die forming by forging of light alloy, or the like. For example, a substantially triangular lightening part 53 is formed in a central part of the top face in the valve connecting part 31*a*, and a pair of lightening parts 54 and 54 are formed in opposite sides of a bottom face of the valve connecting part 31*a*, which is the face at the opposite side from the top face to be disposed to alternate with the lightening part 53.

Incidentally, the lightening parts 53, 54 and 54 are formed at the same time as the die forming of the intake-side rocker arm 31, and while the draft angle of the upper lightening part 53 is in the direction to widen an opening area of the lightening part 53 toward the top face of the valve connecting part 31*a*, draft angles of the lower lightening parts 54 and 54 are in the direction to widen opening areas of the lightening parts 54 and 54 toward the bottom face of the valve connecting part 31*a*. Therefore, the inclination direction of the inner face of the lightening part 53 and the inclination directions of the inner faces of the lightening parts 54 and 54 are the same, and thicknesses of the wall parts 31*d* and 31*d* formed between the lightening parts 53 and 54; and 53 and 54 adjacent to each other are substantially uniform.

Figure 7:
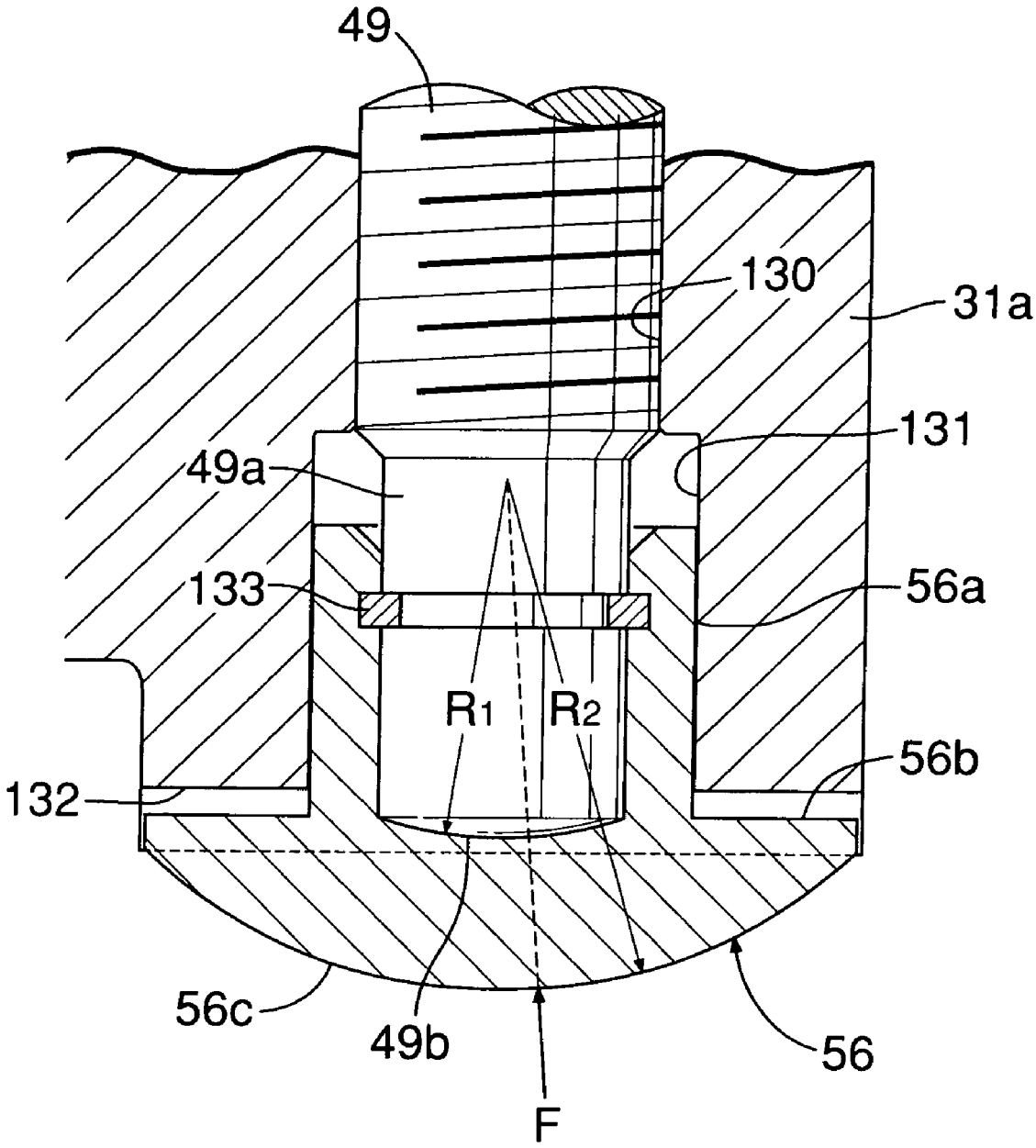
Figure 8:
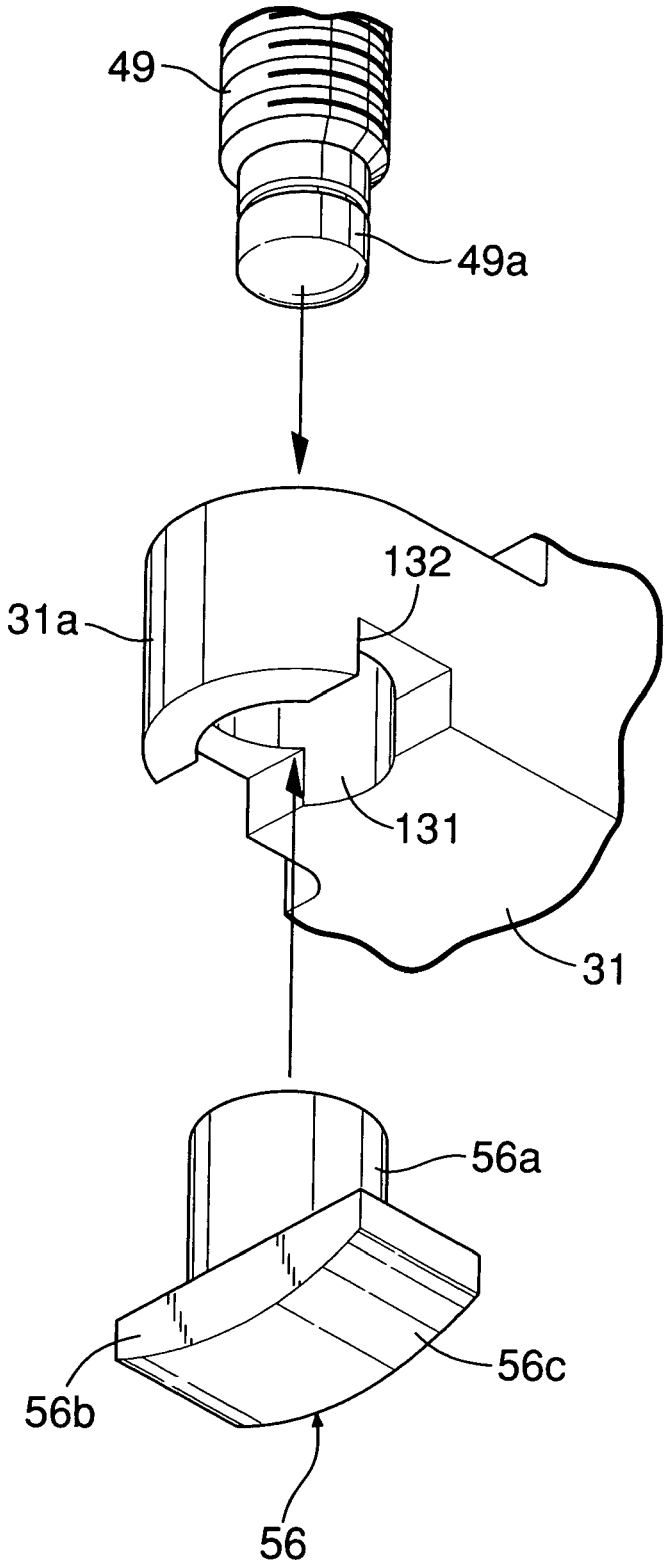

Referring to FIGS. 7 and 8, a tappet member 56 is formed into a shape in which an annular boss portion 56*a* and a boat-form sole portion 56*b* are integrated. The bottom 56*c* of the sole portion 56*b* is formed so as to form a part of a cylindrical surface and contact the upper end of the stem 20*a* of the intake valve 20.

A screw hole 130 for receiving an adjust screw 49 and an insertion hole 131 whose one end is coaxially connected to the screw hole 130 so as to insert the boss portion 56*a* of the tappet member 56 and whose other end is opened at the downside of the valve connecting portion 31*a* of an intake-side locker and 31, are formed on the valve connecting portion 31 a of the locker arm 31. The insertion hole 131 is formed to have a diameter larger than the screw hole 130. Moreover, an engagement groove 132 is formed at the downside of the valve connecting portion 31*a* so as to cross the other end of the insertion hole 131. The sole portion 56*b* of the tappet member 56 is engaged with the engagement groove 132, whereby rotation of the tappet member 56 about the shaft line is controlled though it can shift in the axial direction of the boss portion 56*a*. The position at which the engagement groove 132 is formed is determined so that the bottom 56*c* forming a part of the cylindrical surface in the tappet member 56 face-contacts the stem 20*a* of the intake valve 20 always in the same state also by the rocking motion of the intake-side locker arm 31.

A rod portion 49*a* fitted to the boss portion 56*a* of the tappet member 56 is integrally and coaxially formed at the front end of the adjust screw 49 screwed into the screw hole 130. A snap ring 133 is provided between the rod portion 49*a* and the boss portion 56*a* so as to allow the relative rotation about the axis, but prevent the relative movement in the axial direction. Therefore, when rotation-operating the adjust screw 49 in order to adjust the tappet, the tappet member 56 is shifted in the shaft direction without rotating by the rotation control by the engagement groove 132. Thus, it is possible to easily adjust the tappet by the adjust screw 49 and a locknut 134 screwed over the adjust screw 49 and engaged with the valve connecting portion 31*a*.

The bottom 56*c* of the tappet member 56 face-contacts the stem 20*a* of the intake valve 20 at a part of the cylindrical surface independently of tappet adjustment, thereby decreasing the contact face pressure between the stem 20*a* and the tappet member 56. Moreover, when the tappet member 56 slides with the stem 20*a* by face contact the rocking motion of the intake-side locker arm 31, the oil film thickness at the sliding portion increases, to thereby realize a tappet mechanism whose durability is improved. Moreover, as described above, because the contact face pressure lowers, it is possible to set the abrasion resistance of the stem 20*a* to a comparatively small value, and thus use an inexpensive material. Therefore, it is possible to lower the component cost.

Furthermore, the front end 49*b* of the rod portion 49*a* is formed by a part of a sphere; the inside of the closed end of the boss portion 56*a* is also formed by a part of a sphere; and the front end 49*b* of the rod portion 49*a* contacts the inside of the closed end of the boss portion 56*a*. Furthermore, the radius R1 of the sphere of the front end 49*b* of the rod portion 49*a* and the radius R2 of the sphere of the bottom 56*c* of the tappet member 56 are determined so that the radius R1 and the radius R2 has the same center. Therefore, even if a load F from the stem 20*a* works on any portion of the bottom 56*c* of the tappet member 56, the direction of the load F works toward centers of the both radiuses R1 and R2 as shown in FIG. 7. Thus, even if a large load is applied to the tappet member 56, a force by which the tappet member 56 is shifted from the adjust screw 49 does not occur, and abnormal noises or abrasion at the insertion portion of the rod portion 49*a* at the tapped member 56 does not occur. Moreover, because the adjust screw 49 does not have a contacting portion during operation in this mechanism, it is not necessary to form the adjust screw 49 from a particularly hard material, thereby decreasing the cost.

Thus, it is possible to improve the abrasion resistance by decreasing the face pressure of the tappet member 56, thereby decreasing a degree of freedom in design of the conventional locker arm with respect to a portion under restriction due to the durability of a tappet member. Therefore, it is possible to design a compact, lightweight, and high-rigidity engine valve operating system. Also, the face contact state is kept by the cylindrical surface at the time of high lift and low lift as well as in any state therebetween. Therefore, the engine valve is the most suitable for the tappet structure of the engine valve system of an internal combustion engine in which a valve lift amount becomes variable. Particularly, in the engine valve operating system having the variable valve lift mechanism 32, it is possible to avoid an impact which becomes strong at start of opening of a valve at the time of small-load minute lift by the above tappet structure, or decrease the impact.

It is possible to freely use any curved surface for the shape of the bottom 56*c* of the tappet member 56 in addition to the cylindrical surface. Moreover, it is possible to improve the durability of a portion having a large face pressure by increasing the curvature radius or change valve lift curves.

A pair of tappet members 55 . . . capable of adjusting a tappet clearance by adjust screws 44 . . . are attached to the other end of an exhaust-side locker arm 36 with the tappet structure same as the tappet structure of the intake-side locker arm 31.

Figure 9:
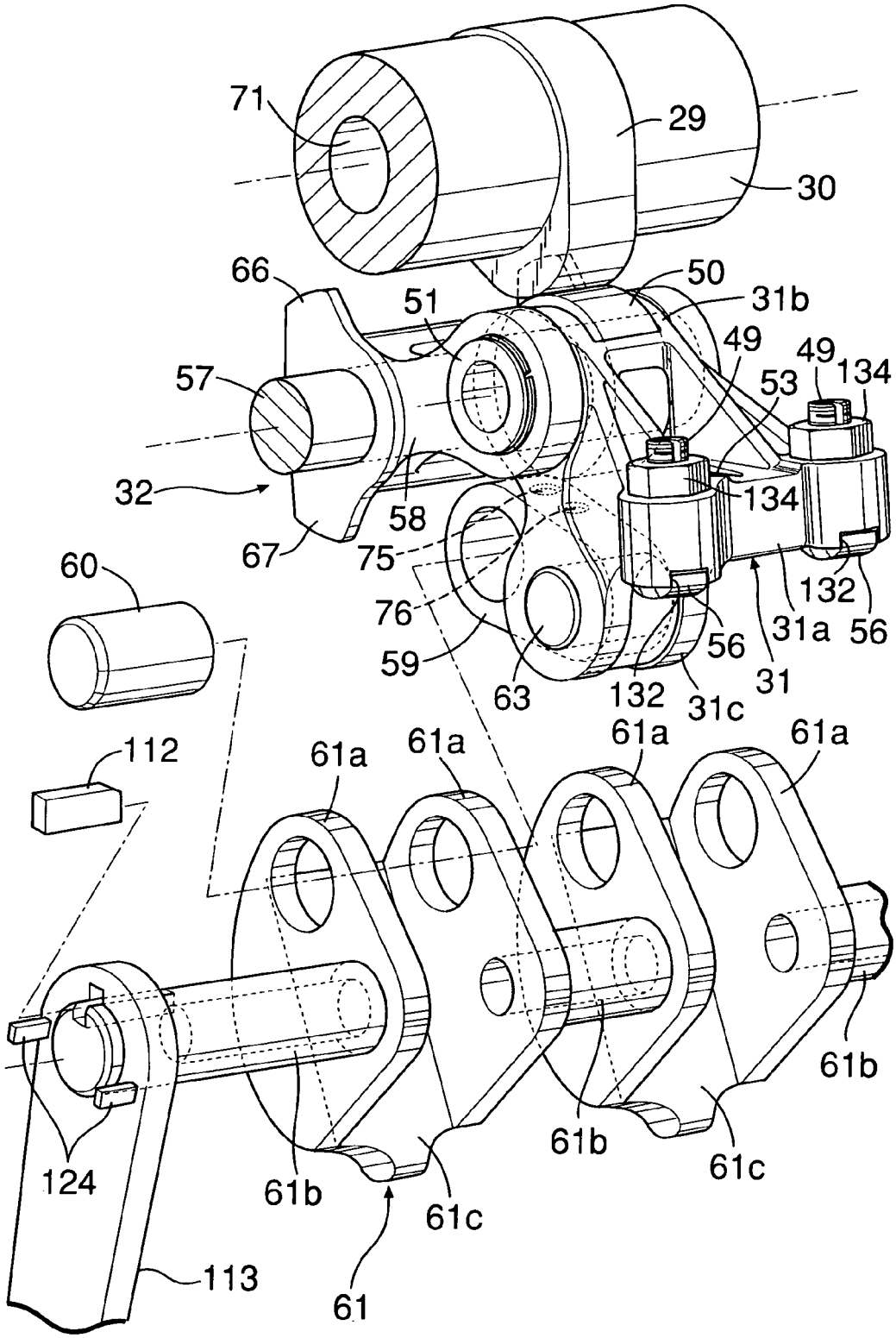
Figure 10:
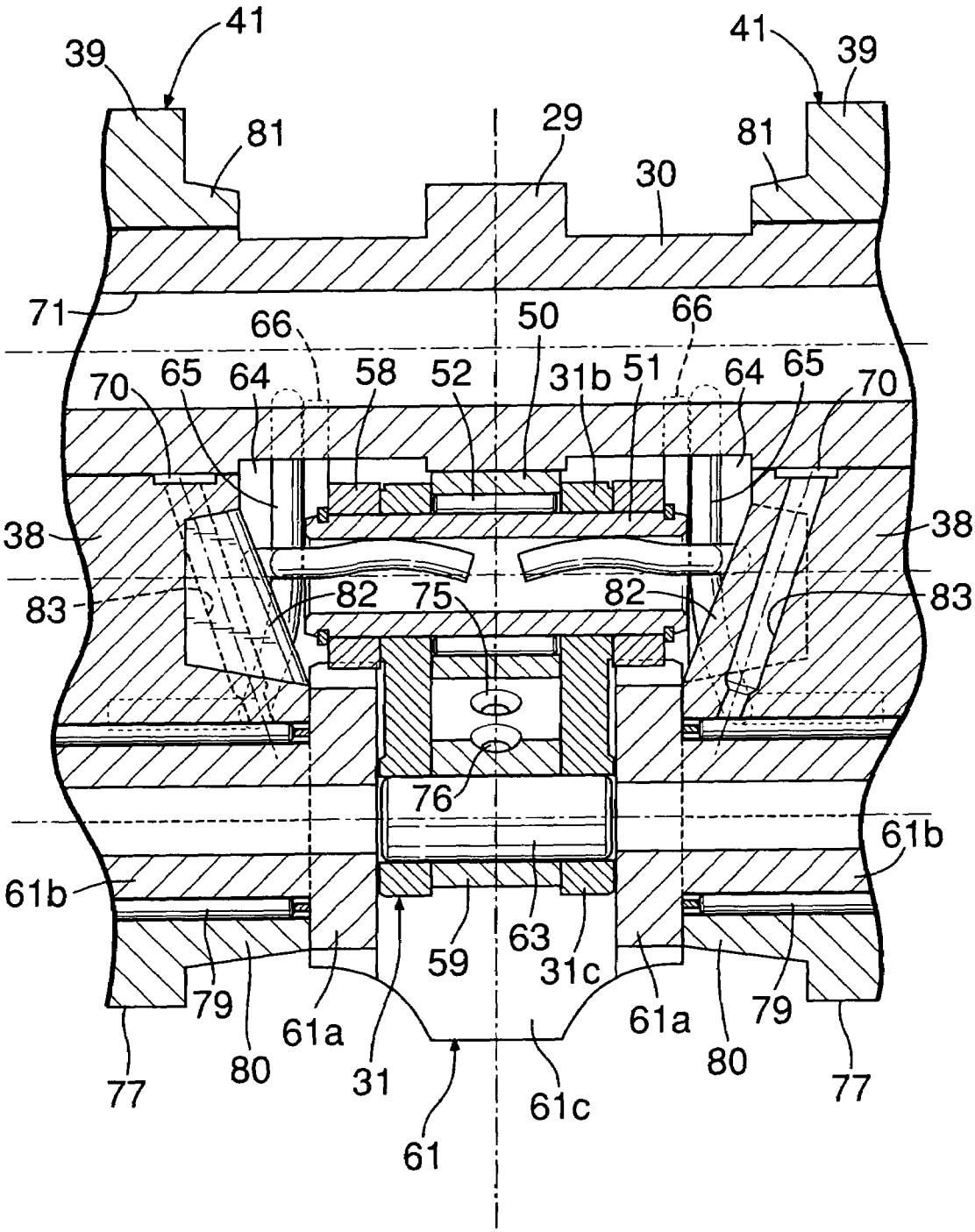

In FIGS. 9 and 10, the variable valve lift mechanism 32 includes: a first link arm 58 whose one end is rotatably supported by the first support portion 31*b* of the intake-side locker arm 31 and whose other end is rotatably supported at the fixing position of the engine body 11 through an intake-side locker shaft 57; a second link arm 59 whose one end is rotatably connected to the second support portion 31*c* of the intake-side locker arm 31; and a movable support shaft 60. A control shaft 61 for controlling the variable valve lift mechanism 32 is connected to the movable support shaft 60 so that the control shaft 61 angular-displaces the movable support shaft 60 about an axis parallel with the axis of the shaft 60.

One end portion of the first link arm 58 is formed into a substantially U-shape to catch the first support part 31*b* of the intake-side rocker arm 31 from opposite sides, and is rotatably connected to the first support part 31*b* via the first connecting shaft 51 which pivotally supports the roller 50 at the intake-side rocker arm 31. The intake-side rocker shaft 57, which rotatably supports the other end portion of the first link arm 58, is supported by the upper holders 38 . . . fastened to the cylinder head 14.

One end portion of the second link arm 59 disposed under the first link arm 58 is disposed to be caught by the second support part 31*c* of the intake-side rocker arm 31, and is rotatably connected to the second support part 31*c* via a second connecting shaft 63.

Support bosses 64 and 64 are integrally provided to protrude at the upper holders 38 and 38 at opposite sides of the other end portion of the first link arm 58 so as to support the intake-side rocker shaft 57, and with these support bosses 64 . . . , movement of the other end portion of the first link arm 58 in the direction along the axis of the intake-side rocker shaft 57 at the other end portion of the first link arm 58 is restrained.

Incidentally, both the intake valves 20 . . . are biased in the valve closing direction by the valve springs 23 . . . , and the roller 50 of the intake-side rocker arm 31 is in contact with the intake-side valve operating cam 29 by the work of the valve springs 23 . . . when both the intake valves 20 . . . biased by spring in the valve closing direction is driven to the valve opening direction by the intake-side rocker arm 31. In the valve closed state of the intake valves 20 . . . , the spring force of the valve springs 23 . . . does not act on the intake-side rocker arm 31, the roller 50 separates from the intake-side valve operating cam 29, and there is the possibility that the control precision of the amount of valve lift when the intake valves 20 . . . are slightly opened is reduced. Therefore, the intake-side rocker arm 31 is biased in the direction to make the roller 50 abut to the intake-side valve operating cam 29 by rocker arm biasing springs 65 . . . separate from the valve springs 23 . . .

The rocker arm biasing springs 65 . . . are coil-shaped torsion springs which surround the support bosses 64 . . . , and are provided between the engine body 11 and the intake-side rocker arm 31. Namely, one ends of the rocker arm biasing springs 65 . . . are engaged in the support bosses . . . , and the other ends of the rocker arm biasing springs 65 . . . are inserted and engaged in the first connecting shaft 51 which is hollow and operated integrally with the intake-side rocker arm 31.

The other end portion of the first link arm 58 is formed into a cylindrical shape so that an outer circumference is disposed at an inner side in the side view from an outer periphery of the rocker arm biasing springs 65 . . . which are wound in a coil shape, and a plurality of, for example, pairs of protruding parts 66 and 67 which inhibit the rocker arm biasing springs 65 . . . from falling to the first link arm 58 side are respectively provided to protrude, spaced in the circumferential direction at opposite ends in the axial direction at the other end portion of the first link arm 58. Accordingly, the fall of the rocker arm biasing springs 65 . . . is prevented while avoiding increase in size of the other end portion of the first link arm 58, and support rigidity of the other end portion of the first link arm 58 can be enhanced.

The protruded parts 66 and 67 are disposed to avoid the operation range of the second link arm 59, and therefore, the operation range of the second link arm 59 can be sufficiently secured irrespective of the protruded parts 66 and 67 . . . being provided at the other end portion of the first link arm 58.

Oil jets 68 . . . , which supply oil to the upper portion of the other end side of the intake-side rocker arm 31, are attached to caps 39 . . . in the intake cam holders 41 . . . provided at the engine body 11.

Incidentally, a passage 69 which guides oil from an oil pump not shown is provided at one of a plurality of upper holders 38 . . . . Arc-shaped recessed parts 70 . . . are provided at the upper portion of each of the upper holders 38 . . . to oppose to the lower half part of the intake-side camshaft 30, and the passage 69 communicates with one of the recessed parts 70 . . . . An oil passage 71 is coaxially provided in the intake-side camshaft 30, and, at the portions corresponding to the respective intake-side cam holders 41 . . . , the intake-side camshaft 30 is provided with communication holes 72 . . . of which inner ends are allowed to communicate with the oil passage 71 are provided so that the outer ends of the communication holes 72 . . . open to the outer surface of the intake-side camshaft 30. Therefore, lubricating oil is supplied between the intake-side cam holders 41 . . . and the intake-side camshaft 30 via the communication holes 72 . . . .

On the bottom surfaces of the caps 39 . . . , which construct the intake-side cam holders 41 . . . with the upper holders 38 . . . , recessed parts 73 . . . , which form passages leading to the recessed parts 70 . . . in a space from upper surfaces of the upper holders 38 . . . , are provided, and the oil jets . . . 68 are mounted to the caps 39 . . . so as to communicate with the recessed parts 73 . . . and link to passages 74 . . . which are provided in the caps 39 . . . .

The oil jets 68 . . . are mounted to the caps 39 . . . of the intake camholders 46 . . . provided at the engine body 11 to rotatably support the intake-side camshaft 30 as above, and a sufficient amount of oil at sufficiently high pressure can be supplied from the oil jets 68 . . . by utilizing oil passage for lubricating spaces between the intake-side camshaft 30 and the intake-side cam holders 41 . . . .

Since oil is supplied from the oil jet 68 toward the upper first connecting shaft 51 of the first and second connecting shafts 51 and 63 which connect one end portions of the first and the second link arms 58 and 59 to the intake-side rocker arm 31, the oil which lubricates a space between the first link arm 58 and the intake-side rocker arm 31 flows down to the lower second link arm 59.

Oil introduction holes 75 and 76 with parts of the movable support shaft 60 and the second connecting shaft 63 faced to intermediate portions are provided in the second link arm 59 in a perpendicular direction to a straight line which connects axes of the movable support shaft 60 and the second connecting shaft 63, and one end of each of the oil introduction holes 75 and 76 is opened to the first connecting shaft 51 side. Accordingly, the oil which flows downward from the first link arm 58 is effectively guided between the second link arm 59, and the movable support shaft 60 and the second connecting shaft 63, and connecting parts of the intake-side rocker arm 31 and the first and second link arms 58 and 59, and a space between the second link arm 59 and the movable support shaft 60 are lubricated, thus making it possible to ensure smooth valve operating action.

The control shaft 61 is a single member which is supported at the engine body 11 for common use in a plurality of cylinders arranged in line, and is constructed into a crank shape having webs 61*a* and 61*a* disposed at opposite sides of the intake-side rocker arm 31, journal portions 61*b* and 61*b* which perpendicularly link with outer surfaces of base end parts of both the webs 61*a* and 61*a* and are rotatably supported by the engine body 11, and a connecting part 61*c* which integrally connects both the webs 61*a* and 61*a* at a position where interference with the second link arm 59 is avoided for each cylinder. The movable support shaft 60 is connected to the control shaft 61 so as to connect the both webs 61*a* and 61*a*.

The respective journal portions 61*b* . . . of the control shaft 61 are rotatably supported between the upper holders 38 . . . connected to the cylinder head 14 of the engine body 11, and lower holders 77 . . . connected to the upper holder 38 from below. The lower holders 77 . . . are formed to be separate from the cylinder head 14 to be fastened to the upper holders 38 . . . , and recessed parts 78 . . . in which the lower holders 77 . . . are disposed are provided on the top face of the cylinder head 14.

Needle bearings 79 . . . are interposed between the upper and lower holders 38 . . . and 77 . . . , and the journal portions 61*b* . . . , and the roller bearings 79 . . . are capable of being split in halves to be interposed between the journal portions 61*b* . . . of the control shaft 61, which has a plurality of webs 61*a*, 61*a* . . . and connecting parts 61*c* . . . and is for common use in a plurality of cylinders, and the upper and lower holders 38 . . . and 77 . . . .

Control shaft support bosses 80 . . . which protrude to webs 61*a* . . . of the control shaft 61 are formed in the upper and lower holders 38 . . . and 77 . . . to allow the journal portion 61*b* to penetrate therethrough. Camshaft support boss parts 81 . . . through which the intake-side camshaft 30 is penetrated through are formed in the upper holders 38 . . . and the caps 39 . . . joined to each other to collaborate to construct the intake-side cam holders 41 . . . to protrude toward the intake-side rocker arms 31 . . . , and ribs 82 . . . which connect the control shaft support boss parts 80 . . . and the camshaft support boss parts 81 . . . are integrally provided in the upper holders 38 . . . .

Passages 83 . . . which guide oil to the roller bearings 79 . . . side are provided inside the ribs 82 . . . to communicate with the recessed parts 70 . . . of the top faces of the upper holders 38 . . . .

While the exhaust-side valve operating system 33 is placed at the cylinder head 14 so that the swing support part of the exhaust-side rocker arm 36 is disposed outside from the linking and connecting part of the exhaust-side rocker arm 36 to the exhaust valves 21 . . . , the intake-side valve operating system 28 is placed at the cylinder head 14 so that the intake-side rocker shaft 57 and the movable support shafts 60 . . . are placed inside from the linking and connecting parts of the intake-side rocker arms 31 . . . to the intake valves 20 . . . .

A plug cylinder 87, into which an ignition plug 86 mounted to the cylinder head 14 to face the combustion chamber 17 is inserted, is mounted to the cylinder head 14 between the intake-side and exhaust-side valve operating systems 28 and 33, and the plug cylinder 87 is disposed to tilt closer to the exhaust-side valve operating system 33 toward the above.

Thus, the control shaft 61 in the intake-side valve operating system 28 is disposed between the intake valves 20 . . . and the plug cylinders 87 . . . so that the outer faces of the connecting parts 61*c* . . . are opposed to the plug cylinders 87 . . . , and relief grooves 88 . . . to avoid interference with the plug cylinders 87 . . . are formed on the outer faces of the connecting parts 61*c* . . . .

When the intake valves 20 . . . are in the valve closed state, the second connecting shaft 63, which connects the second link arm 59 to the intake-side rocker arm 31, is on the same axis as the journal portions 61*b* . . . of the control shaft 61, and when the control shaft 61 swings around the axes of the journal portions 61*b* . . . , the movable support shaft 60 moves on the arc with the axis of the journal portions 61*b* . . . as the center.

When the control shaft 61 rotates in the direction in which the movable support shaft 60 lowers, and the roller 50 is pressed by the intake-side engine valve operating cam 29 of the intake-side cam shaft 30, a four-bar link connecting the intake-side locker shaft 57, first connection shaft 51, second connection shaft 63, and movable support shaft 60 is deformed, the intake-side locker arm 31 rocks downward, the tappet members 56 . . . press the stems 20*a* . . . of the intake valve 20, to open the intake valves 20 . . . at a low lift.

Moreover, when the control shaft 61 rotates in the direction in which the movable support shaft 60 rises, and the roller 50 is pressed by the intake-side engine valve operating cam 29 of the intake cam shaft 30, the four-bar link is deformed, the intake-side locker arm 31 rocks downward, the tappet members 56 . . . press the step 20*a* of the intake valves 20 . . . , to open the intake valves 20 . . . at a high lift.

Figure 11:
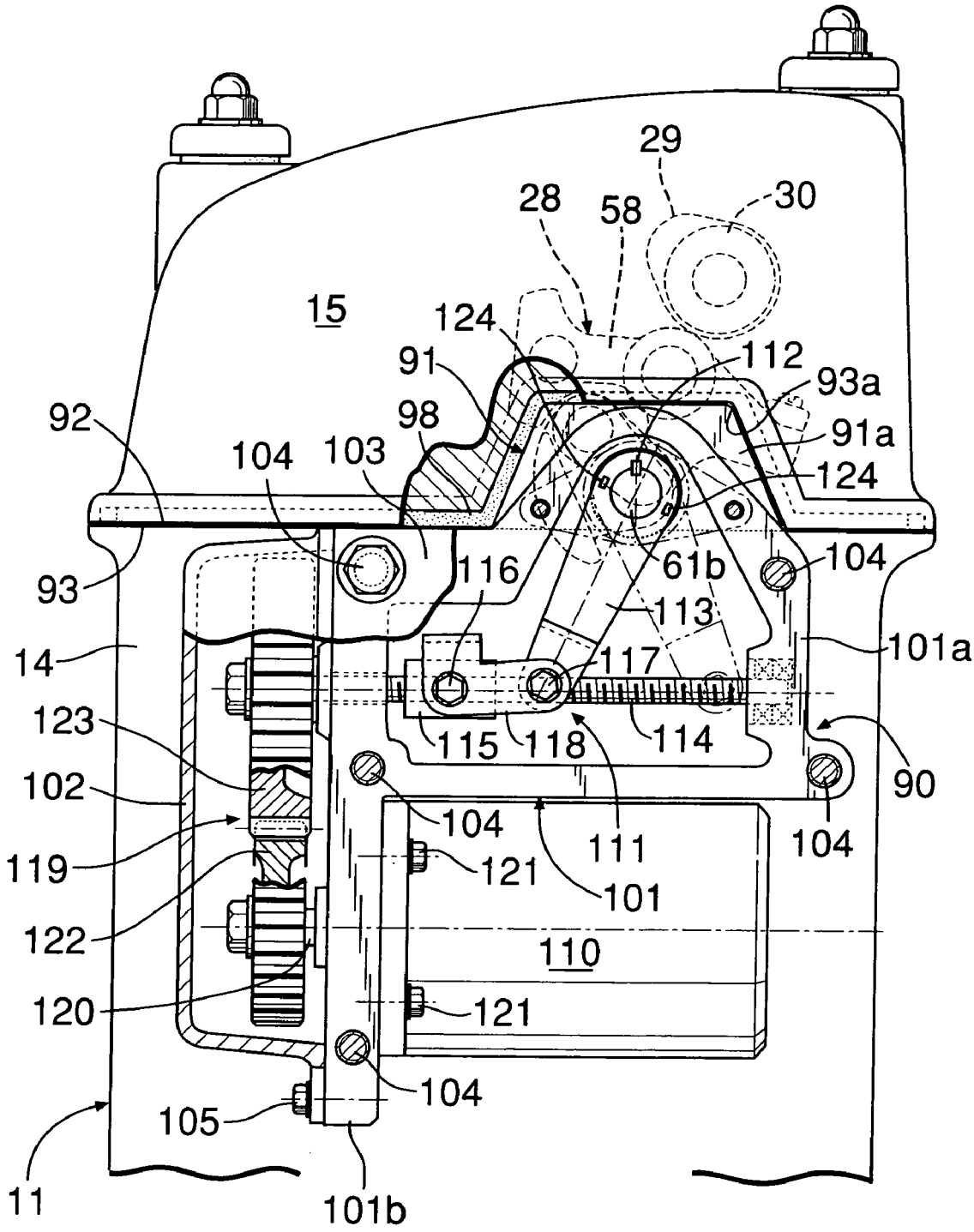
Figure 12:
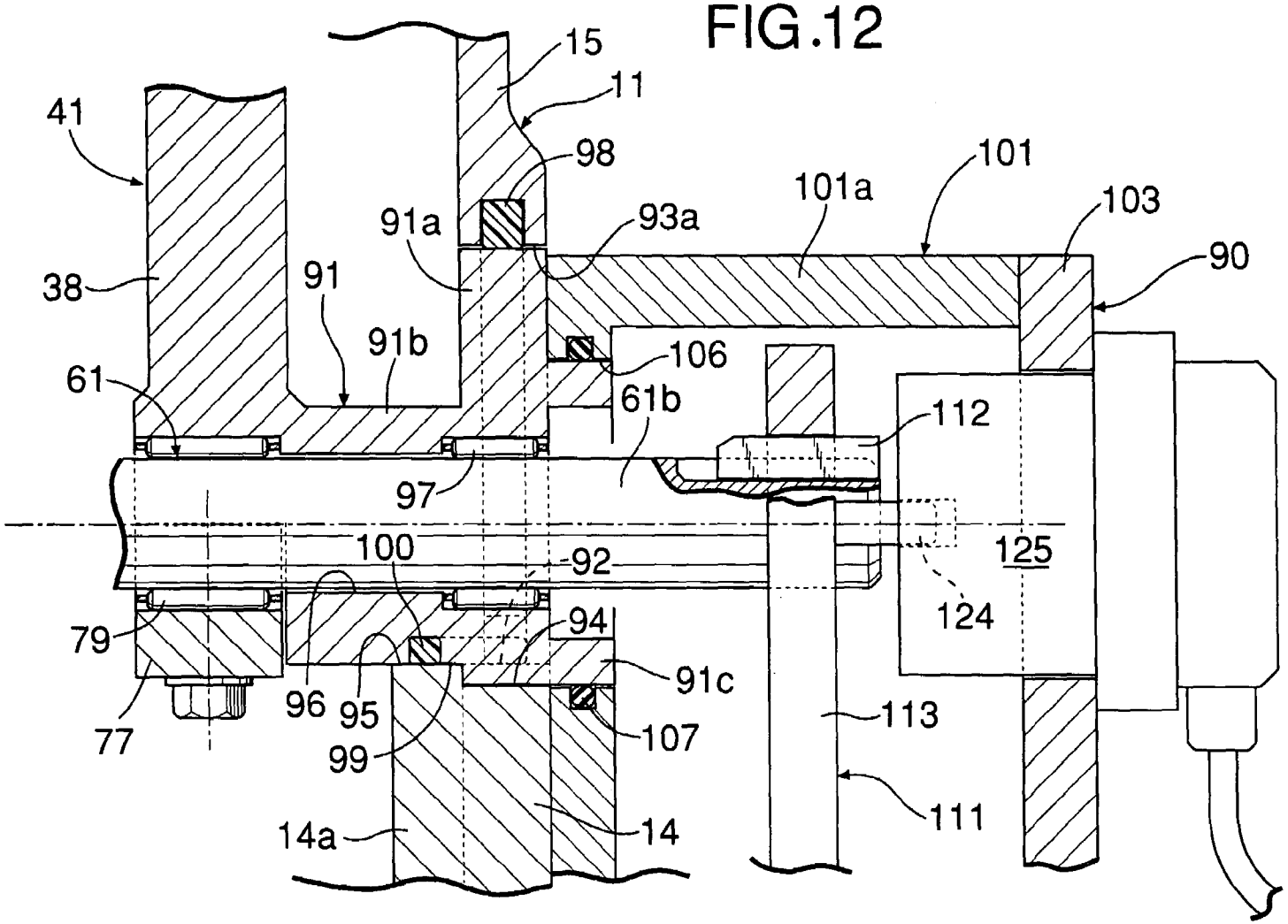

In FIGS. 11 and 12, one end of the control shaft 61 along the cylinder arrangement direction, that is, a journal portion 61*b* at one end of a plurality of journal portions 61*b* . . . of the control shaft 61 along the cylinder arrangement direction, is protruded from the sidewall of the cylinder head 14 of the engine body 11 and inserted into the casing 90 coupled to the outside of the sidewall surface. While surrounding the portion 61*b* at one end along the cylinder arrangement direction, a positioning section 91 having a part protruding out of the cylinder head 14 and the outer face of the sidewall of the head cover 15 of the engine body 11 is integrally provided in the upper holder 38 at one end of a plurality of upper holders 38 . . . attached to the cylinder head 14 to support the upper half portions of the journal portions 61*b* . . . at the circumference.

The mating face 92 of the head cover 15 to the cylinder head 14 is flatly formed, but a concave portion 93*a* opening downward is formed on a portion corresponding to the positioning section 19 of the mating face 93 of the head cover 15 to the cylinder head 14, and a concave portion 94 depressed into a circular arc is formed on a portion corresponding to the concave portion 93*a* of the mating face 93 of the cylinder head 14 so as to be also opened to the outside. Moreover, a vertically-extending ridge 14*a* is integrally provided on the inner surface of the sidewall of the cylinder head 14, and the upper face of the ridge 14*a* forms a flat sealing face 95 having a substantially U-shape and flush with the mating face 92 to surround the concave portion 94.

The positioning section 91 integrally includes: a held portion 91*a* formed into substantially trapezoid so as to be held between the concave portion 93*a* of the mating face 92 of the cylinder head 14 and the mating face 93 of the head cover 15; a connection portion 91*b* for connecting the held portion 91*a* with the upper holder 38; and a cylindrical convex portion 91*c* connected to the lower portion of the held portion 91*a* so as to protrude a part of the convex portion 91*c* out of the cylinder head 14 and the outer face of the sidewall of the head cover 15.

A through-hole 96 passing the journal portion 61*b* of the control shaft 61 is formed on the positioning section 91. A needle bearing 97 is inserted between the inner face at the outer end of the through-hole 96 and the journal portion 61*b*.

A sealing member 98 is inserted between the mating faces 92 and 93 of the cylinder head 14 and head cover 15, and is attached to the mating face 93 of the head cover 15. The sealing member 98 is formed also so as to be inserted between the inner face of the concave portion 93*a* of the mating face 93 and the held portion 91*a* of the positioning section 91. Moreover, in the positioning section 91, the lower portion of the convex portion 91*c* is fitted to the concave portion 94 of the mating face 92. The lower face of the positioning section 91 excluding the convex portion 91*c* is formed as a flat sealing face 99 corresponding to the mating face 92 of the cylinder head 14. The sealing face 95 and a sealing member 100 formed into a substantially U-shape so as to surround the convex portion 91*c* is inserted between the mating face 92 of the cylinder head 14, sealing face 95, and sealing face 99 so as to connect the both ends of the sealing portion 100 to the sealing member 98.

The casing 90 is constituted by a casing body 101, a bowl-shaped case 102 fastened to the casing body 101, and a lid member 103 connected to the casing body 101.

The casing body 101 integrally has a case portion 101*a* formed into the shape of a box whose side opposite to the cylinder head 14 is opened, and a support wall portion 101*b* connected to one sidewall of the case 101*a* and extending downward, and is attached to the outer face of the sidewall of the cylinder head 14 by a plurality of bolts 104 . . . . Moreover, the case 102 is fastened to the casing body 101 by a plurality of bolts 105 . . . so as to cover one sidewall of the case 101*a* and the support wall portion 101*b* from the outside, and the lid member 103 is fastened to the case portion 101*a* by fastening together a plurality of bolts 104 for fastening the case 101*a* among the plurality of bolts 104 . . . so as to cover the case portion 101*a* from the side opposite to the cylinder head 14.

That is, the casing 90 is attached to the cylinder head 14 of the engine body 11 so that it can be repeatedly attached and detached by fixing means constituted by the bolts 104 . . . .

A fitting hole 106 to which the convex portion 91*c* protruded from the casing 90 and the outer face of the sidewall of the head cover 15 is fitted, is formed on the end wall contacting with the outer face of the sidewall of the cylinder head 14 in the casing body 101 of the casing 90. An annular sealing member 107 snappily contacting with the circumference of the convex portion 91 is attached to the inner face of the fitting hole 106.

An electric motor 110 serving as a rotational force generating actuator disposed on the outside of the casing 90 is attached to the casing 90. Power conversion means 111 for converting the rotational force of the electric motor 110 into the pivoting force of the journal portion 61*b* serving as one end of the control shaft 61 is housed in the casing 90*k*.

Figure 13:
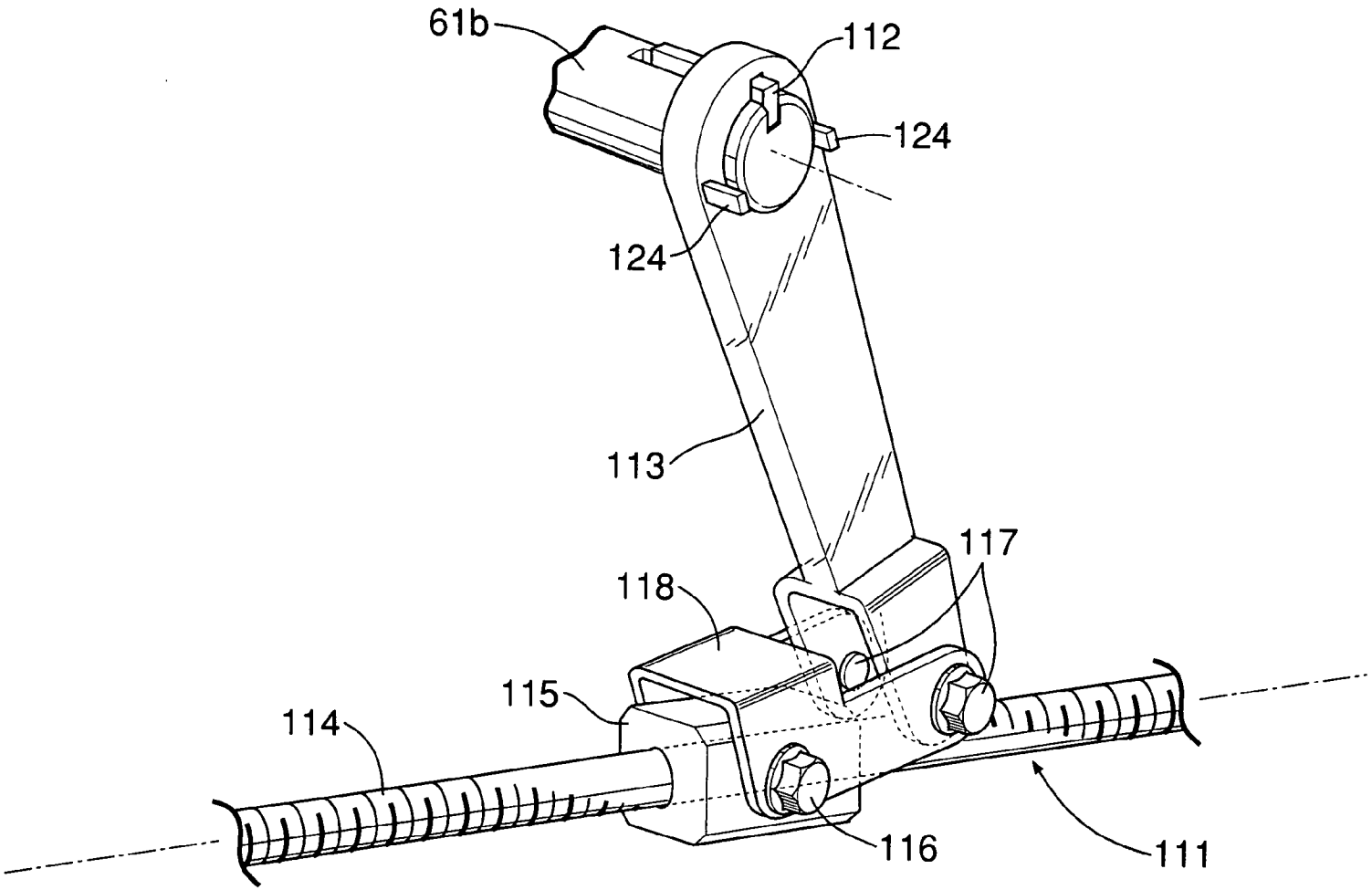

Referring also to FIG. 13, the power conversion means 111 has a control arm 113 whose proximal end is fixed to one end of the journal portion 61*b* inserted into the casing 90 through a key 112, a screw shaft 114 whose axis is disposed on a plane orthogonal to the axis of the journal portion 61*b*, a nut member 115 screwed over the screw shaft 114, a connection link 118 whose one end is connected to the nut member 115 by a pin 116 and whose other end is connected to the control arm 113 through pins 117 and 117, and a reduction gear mechanism 119 provided between the screw shaft 114 and the electric motor 110.

The control arm 113 is housed in the case portion 101*a* of the box body 101 in the casing 90. Most portion of the screw shaft 114 having an axis extending in the horizontal direction is housed in the case portion 101*a* below the journal portion 61*b*. Both ends of the screw shaft 114 are rotatably supported by the sidewall of the case portion 101*a*. Moreover, one of the ends of the screw shaft 114 is inserted into the case member 102.

The electric motor 110 has an output shaft 120 parallel with the axis of the screw shaft 114 whose axis is disposed on a plane orthogonal to the shaft-line axis of the journal portion 61*b*, and is disposed on the outside of the casing 90 below the screw shaft 114. Specifically, the electric motor 110 is disposed below the case portion 101*a* of the casing body 101 of the casing 90, and is attached to the support wall portion 101*b* of the casing body 101 by a plurality of bolts 121 . . . so that one end of the output shaft 120 is inserted into the case member 102.

The reduction gear mechanism 119 is provided between the output shaft 120 of the electric motor 110 and the screw shaft 114, housed in the case member 102, and constituted by a driving gear 122 fixed to the output shaft 120 and a gear 123 to be driven fixed to one end of the screw shaft 114.

A pair of detected portions 124 and 124 are protruded on the proximal end of the control arm 113 so as to be disposed on a virtual circular arc about the axis of the journal portion 61*b* of the control shaft 61. A sensor 125 such as a rotary encoder coaxial with the control shaft 61 is attached to the lid member 103 serving as a wall portion opposite to one end of the journal portion 61*b* of the casing 90, so as to detect the pivoting amount of the control shaft 61 by detecting the portions 124 and 124 to be detected.

Next, explaining the operation of this embodiment, in the variable valve lift device 32 which continuously changes the valve opening lift amount of the intake valves 20 . . . , one end portions of the fist and second link arms 58 and 59 are connected in parallel to the intake-side rocker arm 31 having the valve connecting part 31*a* linked and connected to a pair of intake valves 20 . . . to be relatively rotatable, and the other end portion of the first link arm 58 is rotatably supported by the intake-side rocker shaft 57 supported by the engine body 11, while the other end portion of the second link arm 59 is rotatably supported by the displaceable movable support shaft 60.

Accordingly, it is possible to change the amount of lift of the intake valves 20 . . . by continuously displacing the movable support shaft 60, and it is possible to control the intake amount by making the throttle valve unnecessary. In addition, the one end portions of the first and second link arms 58 and 59 are directly connected to the intake-side rocker arm 31 to be rotatable, thus making it possible to reduce the space where both the link arms 58 and 59 are disposed to make the valve operating system compact, and the power from the intake-side valve operating cam 29 is directly transmitted to the roller 50 of the intake-side rocker arm 31, thus making it possible to ensure excellent follow-up ability to the intake-side valve operating cam 29. The positions of the intake-side rocker arm 31, the first and second link arms 58 and 59 in the direction along the axis of the intake-side cam shaft 30 are disposed at substantially the same position, and therefore, the intake-side valve operating system 28 in the direction along the axis of the intake-side camshaft 31 can be made compact.

The one end portion of the first link arm 58 is rotatably connected to the intake-side rocker arm 31 via the first connecting shaft 51, and the roller 50 is pivotally supported at the intake-side rocker arm 31 via the first connecting shaft 51. Therefore, rotatable connection of the one end portion of the first link arm 58 to the intake-side rocker arm 31, pivotal support of the roller 50 to the intake-side rocker arm 31 are achieved by the common first connecting shaft 51, whereby the number of components is reduced and the intake-side valve operating system 28 can be made more compact.

In the intake-side valve operating system 28 including the variable lift mechanism 32 of the intake-side and exhaust-side valve operating systems 28 and 33, the intake-side rocker shaft 57 and the movable support shaft 60 are disposed inside from the linking and connecting part of the intake-side rocker arm 31 to the intake valves 20 . . . , and the swing support part of the exhaust-side rocker arm 36 included by the exhaust-side valve operating system 33 is disposed outside from the linking and connecting part of the exhaust-side rocker arm 36 and the exhaust valves 21 . . . . Therefore, even if an angle of nip $\alpha$ (see FIG. 1) of the intake valves 20 . . . and the exhaust valves 21 . . . is set to be small to obtain favorable combustion by making the combustion chamber 17 compact, mutual interference of the intake-side and exhaust-side valve operating systems 28 and 33 can be avoided while avoiding increase in size of the cylinder head 14.

The exhaust-side valve operating system 33 includes the exhaust-side cam shaft 35 having the exhaust-side valve operating cam 34, and the exhaust-side rocker arm 36 which is swingably supported at the engine body 11 via the exhaust-side rocker shaft 43 to swing by following the exhaust-side valve operating cam 34 and linked and connected to the exhaust valves 21 . . . , and the plug cylinder 68 disposed between the intake-side and exhaust-side valve operating systems 28 and 33 is mounted to the cylinder head 14 by being tilted to be closer to the exhaust-side valve operating system 33 toward the above. Therefore, the plug cylinder 68 is disposed to avoid interference of the intake-side and exhaust-side valve operating systems 28 and 33, thus making it possible to contribute to making the entire head 14 more compact.

The control shaft 61 provided in the variable valve lift mechanism 32 of an intake-side engine valve operating system 28 is connected to the movable support shaft 60 so that the control shaft 61 angular-displaces the movable support shaft 60 about the axis parallel with the axis of the shaft 60 and is supported by the engine body 11 at the both sides of the intake-side locker arm 31. Therefore, it is possible to improve the support rigidity of the control shaft 61 by opposite-end support and accurately perform the variable lift quantity control of the intake valves 20.

Moreover, because the single control shaft 61 is supported by the engine body 11 corresponding to a plurality of lined-up cylinders, it is possible to avoid the number of components from increasing to make an engine E compact.

Furthermore, the control shaft 61 is formed into a crank shape by including webs 61*a* and 61*a* arranged at the both sides of the intake-side locker arm 31, journal portions 61*b* and 61*b* rotatably supported by the engine body 11, and a connection portion 61*c* for connecting the both webs 61*a* and 61*a*. The movable support shaft 60 is connected to the control shaft 61 so as to connect the both webs 61*a* and 61*a*. Therefore, it is possible to increase the rigidity of the control shaft 61 to be angular-displacement-driven.

The journal portions 61*b* . . . of the control shaft 61 are rotatably supported between the upper holders 38 . . . joined to the cylinder head 14 of the engine body 11, and the lower holders 77 . . . joined to the upper holders 38 . . . from below. Assembly workability of the control shaft 61 to the engine body 11 can be enhanced, and the lower holders 77 . . . which are separate bodies from the cylinder head 14 are fastened to the upper holders 38 . . . , therefore, making it possible to increase degree of freedom of the design of the cylinder head 14 in supporting the control shaft 61.

Since the roller bearings 79 . . . , which can be split in halves, are interposed between the upper and lower holders 38 . . . and 77 . . . , and the journal portions 61*b* . . . , assembly workability of the control shaft 61 can be enhanced while reducing the friction loss at the support part of the control shaft 61.

The control shaft support boss parts 80 . . . which protrude to the webs 61*a* . . . of the control shaft 61 are formed at the upper and lower holders 38 . . . and 77 . . . joined to each other, and the journal portions 61*b* . . . penetrating through the control shaft support boss parts 80 . . . are rotatably supported between the upper and lower holders 38 . . . and 77 . . . , therefore making it possible to further enhance the support rigidity of the control shaft 61.

The cam shaft support boss parts 81 . . . which protrude toward the intake-side rocker arm 31 are formed in the upper holders 38 . . . and the caps 39 . . . joined to the upper holders 38 . . . from above, and the intake-side camshaft 30 penetrates through the camshaft support boss parts 81 . . . and rotatably supported between the upper holders 38 . . . and the caps 39 . . . . Therefore, the support rigidity of the intake-side camshaft 30 can be enhanced while restraining the number of components for supporting the intake-side camshaft 30 to the minimum.

Since the ribs 82 . . . connecting the control shaft support boss parts 80 . . . and the camshaft support boss parts 81 . . . are provided to protrude at the upper holders 38 . . . , the support rigidity of the control shaft 61 and the intake-side camshaft 30 can be further enhanced.

Incidentally, the control shaft 61 is disposed between the intake valves 20 . . . and the plug cylinder 87 provided at the cylinder head 14 so that the outer face of the connecting part 61*c* is opposed to the plug cylinder 87, and the relief groove 88 for avoiding the interference with the plug cylinder 87 is formed on the outer face of the connecting part 61*c*, therefore making it possible to dispose the plug cylinder 87 closer to the intake-side valve operating system 28, and make the internal combustion engine E compact.

In the intake-side rocker arm 31 of the intake-side valve operating system 28, the lightening parts 53, 54 and 54 which alternate each other are formed on the opposite faces from each other of the valve connecting part 61*a*, and therefore, it is possible to reduce the weight of the intake-side rocker arm 31.

The lightening parts 53, 54 and 54 are also formed at the time of die forming of the intake-side rocker arm 31, and since the draft angles of the lightening parts 53 and 54; and 53 and 54 adjacent to each other are in the opposite directions from each other, the inner faces of the lightening parts 53 and 54; and 53 and 54 adjacent to each other tilt in the same direction. Accordingly, the thickness of the wall parts 31*d* and 31*d* which are formed between the lightening parts 53 and 54; and 53 and 54 adjacent to each other at the intake-side rocker arm 31 is substantially uniform, and rigidity of the intake-side rocker arm 31 can be kept by the wall parts 31*d* and 31*d* of the substantially uniform thickness.

Moreover, the intake-side engine valve operating system 28 has the variable valve lift mechanism 32 for continuously changing lift amount of the intake valves 20 to have a comparatively large number of components. Therefore, also in the case of the intake-side engine valve operating system 28, which has the variable valve lift mechanism 32 likely causing the weight increase of the intake-side engine valve operating system 28, it is possible to decrease the weight of the intake-side engine valve operating system 28 by decreasing the weight of the intake-side locker arm 31, thereby increasing the number of revolutions.

Moreover, a part of the journal portion 61*b* at one end of the control shaft 61 is protruded from the sidewall of the engine body 11 and inserted into the casing 90 attached to the outer face of the sidewall so that it can be repeatedly attached and detached, the electric motor 110 disposed on the outside of the casing 90 is attached to the outer face of the casing 90, and the power conversion means 111 including the screw shaft 114 in which the axis is disposed on a plane orthogonal to the axis of the control shaft 61 is housed in the casing 90 in order to convert the rotational force of the electric motor 110 into the pivoting force of the control shaft 61. That is, because a drive for rotating the control shaft 61 is independently constituted and attached to the outside of the cylinder head 14 of the engine body 11, it is avoided to make the engine body 11 complex and it is possible to attach and detach only the drive to or from the engine body 11. Therefore, it is possible to contribute to improvement of maintenance.

Moreover, the electric motor 110 is attached to the outer face of the casing 90 to have the output shaft 120 of the axis parallel with the screw shaft 114, and the power conversion means 111 is housed in the casing 90 to include the reduction gear mechanism 119 provided between the output shaft 120 and the screw shaft 114.

Therefore, it is possible to restrain the protruded amount of the electric motor 120 and the casing 90 out of the engine body 11 in the direction along the axis of the control shaft 61. Moreover, because the rotational force output from the output shaft 120 of the electric motor 110 can be transferred to the screw shaft 114 through the reduction gear mechanism 119, it is possible to decrease the size of the electric motor 110 to make the electric motor 110 more compact.

Further, because a sensor 125 is disposed at one end of the control shaft 61 50 as to be coaxially faced, it is possible to accurately detect the pivoting amount of the control shaft 61. Furthermore, because the electric motor 110 and the casing 90 are comparatively thinly formed in the direction along the axis of the control shaft 61, it is possible to make compact the whole structure including the electric motor 110, casing 90 and sensor 125, in the axial direction of the control shaft 61 and prevent the engine E from increasing in size.

Moreover, the positioning section 91 surrounding the journal portions 61*b* of the control shaft 61 with a part thereof protruding out of the sidewall of the engine body 11 is integrally provided in the upper holder 38 which is attached to the cylinder head 14 of the engine body 11 and rotatably supports at least a part of the one-end-side circumference of the journal portions 61*b* . . . (upper half in the case of this embodiment). The casing 90 is attached to the outer face of the sidewall of the cylinder head 14, and has the fitting hole 106 for receiving the convex portion 91*c* which is a portion of the positioning section 91 protruded out of the sidewall of the engine body 11. Therefore, when attaching the casing 90 to the outer face of the sidewall of the cylinder head 14, it is possible to easily improve the accuracy in connection between the control shaft 61 at least a part of whose circumference is rotatably supported by the upper holder 38 and the power conversion means 111 in the casing 90, by fitting the positioning section 91 of the upper holder 38 to the fitting hole 106 of the casing 90; and it is possible to attach the casing 90 to the outer face of the sidewall of the cylinder head 14 while improving the accuracy in connection between the control shaft 61 and the power conversion means 111, by providing a slight allowance for the setting position of the casing 90 to the cylinder head 14.

Moreover, the upper holder 38 is attached to the cylinder head 14 constituting a part of the engine body 11 in cooperation with the head cover 15, and the held portion 91*a* serving as a part of the positioning section 91 is held between the mating faces 92 and 93 of the cylinder head 14 and head cover 15. Therefore, it is possible to make compact the variable valve lift mechanism 32 for changing valve-opening lift amount of the intake valve 20 and thus contribute to downsizing of the engine E, by placing the control shaft 61 at a lower position.

Figure 14:
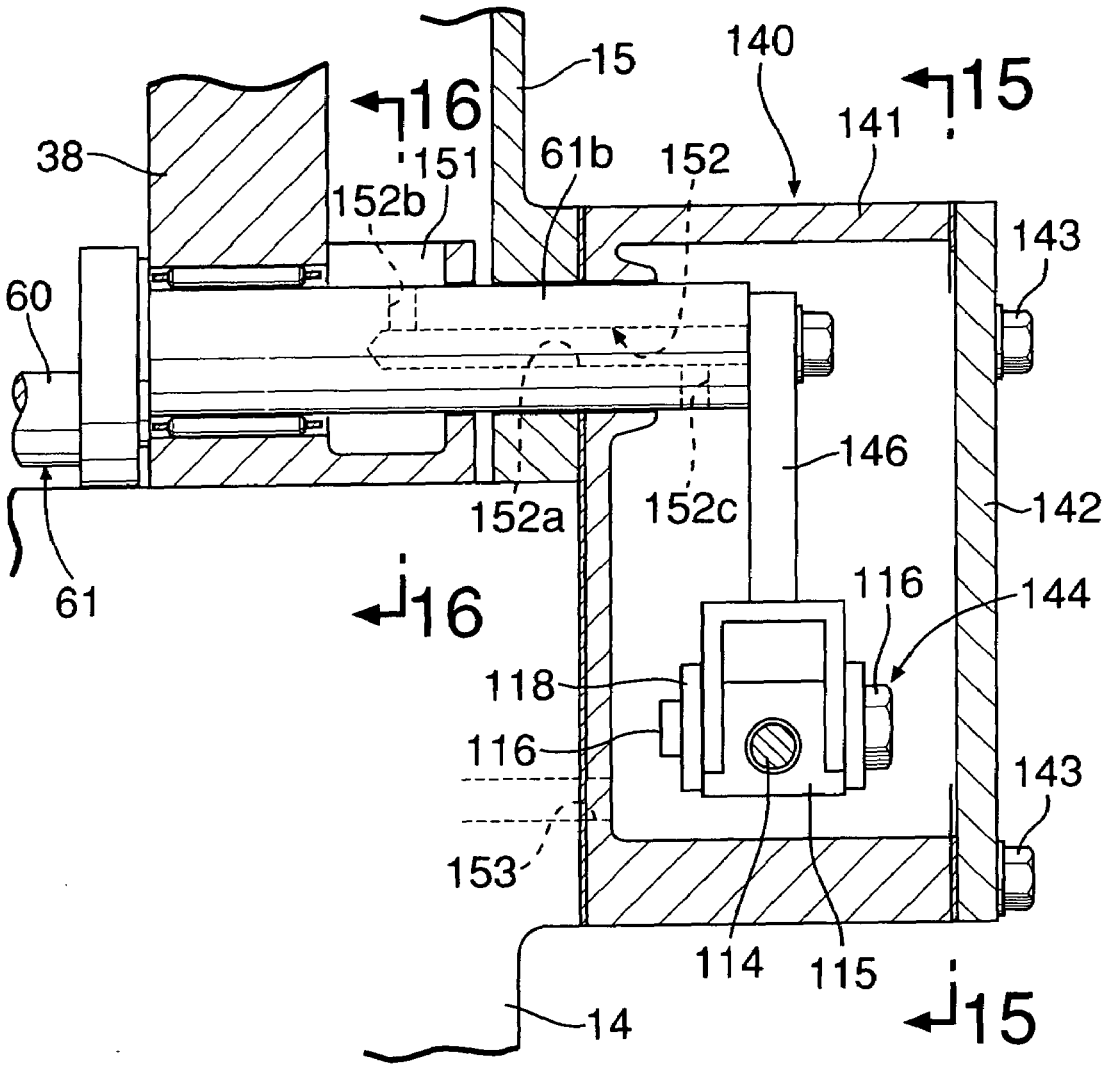
FIGS. 14 to 16 show a second embodiment of the present invention.
Figure 15:
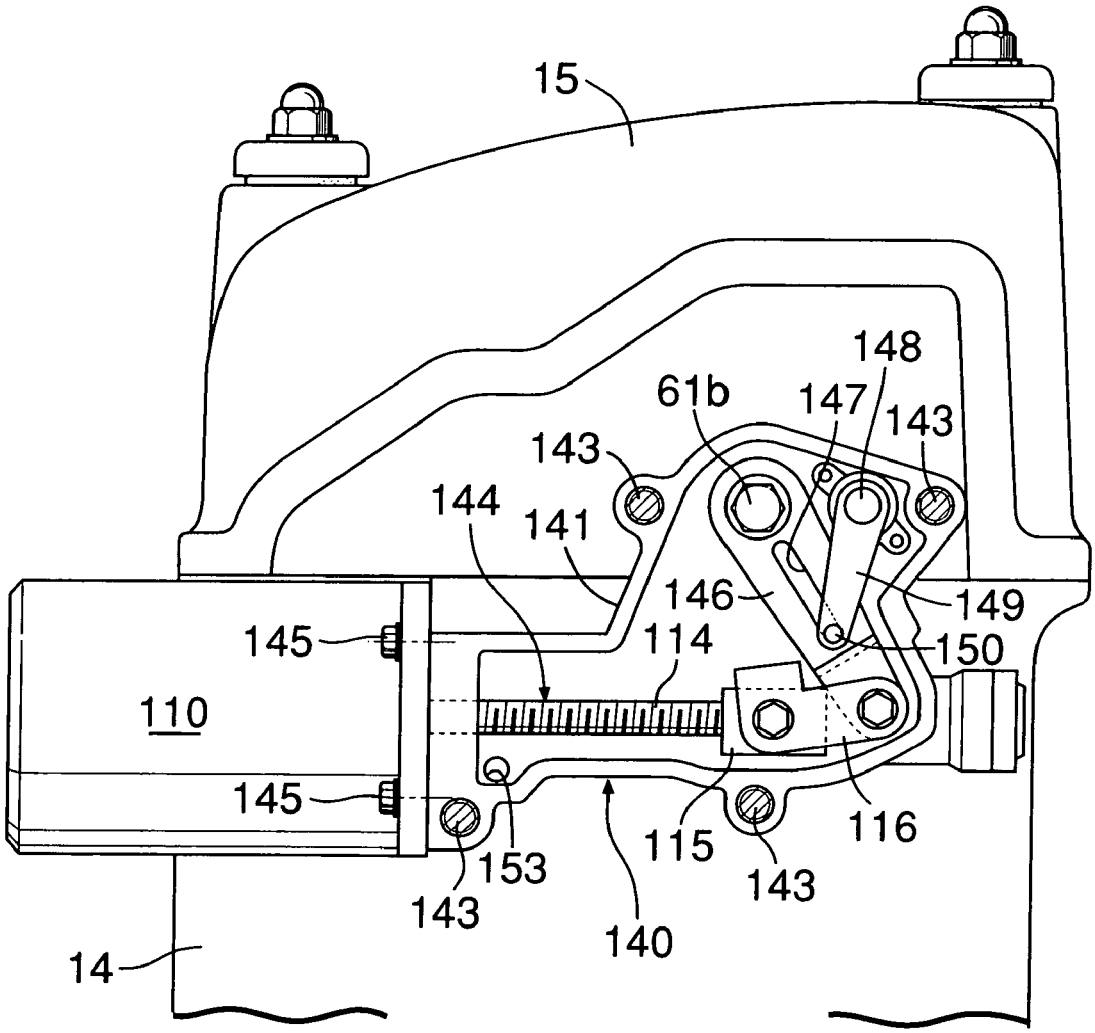
Figure 16:
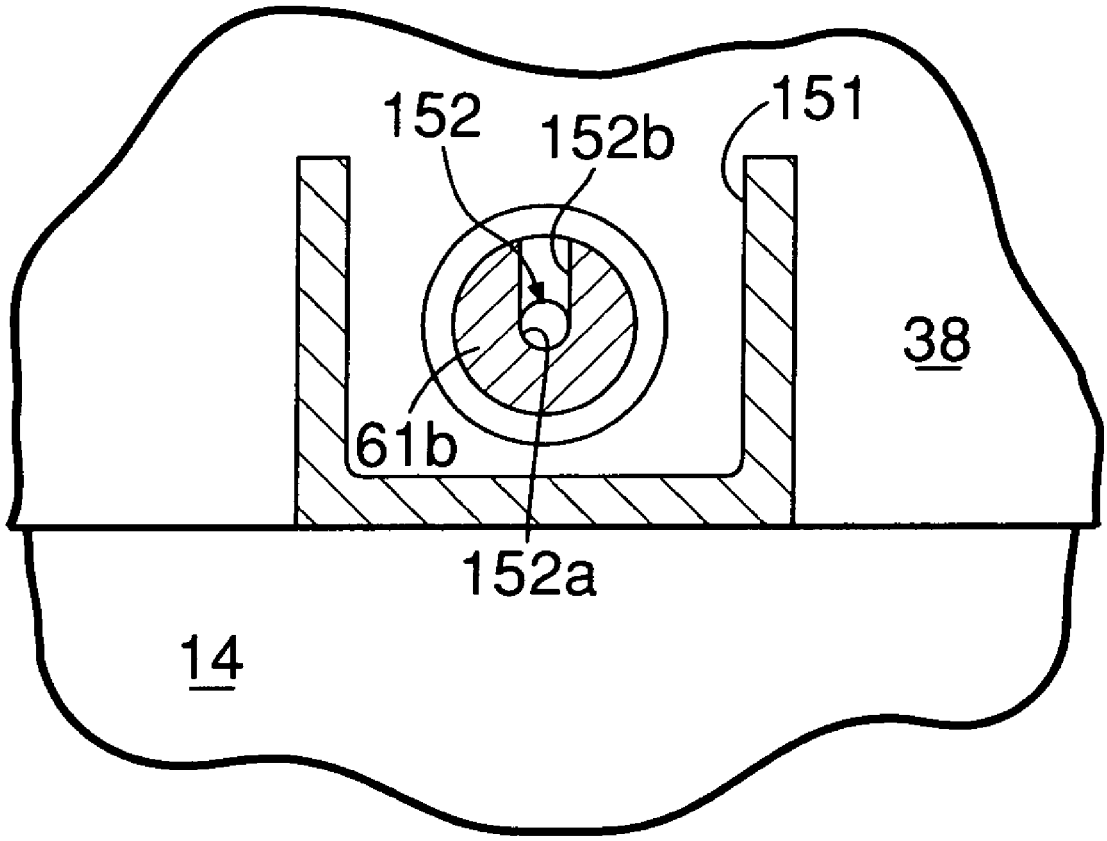

The second embodiment of the present invention is described below with reference to FIGS. 14 to 16. One end of the control shaft 61 along the cylinder arrangement direction, that is, the journal portion 61*b* at one end along the cylinder arrangement direction among a plurality of journal portions 61*b* . . . provided on the control shaft 61 is protruded out of the sidewall of the head cover 15 of the engine body 11 and inserted into a casing 140 attached to the outer faces of the sidewalls of the cylinder head 14 and head cover 15 so as to be repeatedly attached and detached.

The casing 140 is constituted by a casing body 141 and a lid member 142 fastened to the casing body 141. The casing body 141 is formed into the shape of a box opening on a side opposite to the cylinder head 14. The lid member 142 covers the casing body 141 from a side opposite to the cylinder head 14. The casing 140 is attached to the outer faces of the sidewalls of the cylinder head 14 and the head cover 15 by a plurality of bolts 143 . . . inserted into the lid member 142 and casing body 141. That is, the casing 140 is attached to the cylinder head 14 and the head cover 15 of the engine body 11 so that the casing 140 can be repeatedly attached and detached by fixing means constituted by the bolts 143 . . . .

The electric motor 110 serving as a rotational force generating actuator disposed on the outside of the casing 140 is attached to the casing 140, and the power conversion means 145 for converting the rotational force of the electric motor 110 into the pivoting force of the journal portion 61*b* which is one end of the control shaft 61 is housed in the casing 140.

The casing 140 is boxy and the electric motor 110 serving as a rotational force generating actuator disposed on the outside of the casing 140 is attached to the casing 140, and the power conversion means 141 for converting the rotational force of the electric motor 110 into the pivoting force of the journal portion 61*b* which is an end of the control shaft 61 is housed in the casing 140.

The electric motor 110 is disposed on the outer face of the casing 140 while setting its axis to a plane orthogonal to the axis of the journal portion 61*b*, and attached to the sidewall of the casing body 141 by a plurality of bolts 145. . . .

The power conversion means 141 has a control arm 142 whose proximal end is fixed to one end of the journal portion 61*b* inserted into the casing 140, the screw shaft 114 coaxially connected to the electric motor 110, nut member 115 screwed over the screw shaft 114, and a connection link 118 whose one end is connected to the nut member 115 by the pin 116 and whose other end is connected to the control arm 113 through the pins 117 and 117.

A slotted hole 147 extending in the longitudinal direction of the control arm 142 is provided on the control arm 142, a sensor 148 for detecting the rotation amount of the control shaft 61 is attached to the casing body 141 so as to be housed in the casing 140, a pin 150 attached to the front end of a sensor arm 149 of the sensor 148 is engaged with the slotted hole 147.

An oil reservoir 151 surrounding the journal portion 61*b* of the control shaft 61 is formed on the cylinder head 14 constituting a part of the engine body 11. In this embodiment, the oil reservoir 151 is formed on the upper holder 38 at one end along the cylinder arrangement direction among a plurality of upper holders 38 attached to the cylinder head 14 by supporting the upper half portion of the circumference of the journal portions 61*b* . . . , and an oil path 152 whose one end is opened at a portion set in the oil in the oil reservoir 151 is attached to the journal portion 61*b* of the control shaft 61 so as to lead lubricating oil into the casing 140.

The oil path 152 is constituted by a shaft directional hole 152*a* coaxially provided in the journal portion 61*b*, a radius directional hole 152*b* whose inner end is communicated to one end of the shaft directional hole 152*a* and whose outer end opens at the outer face of the journal portion 61*b* in the oil reservoir 151, and a radium directional hole 152*c* whose inner end is communicated with the other end of the shaft directional hole 152*a* and whose outer end opens at the outer face of the journal portion 61*b* in the casing 140.

Therefore, the lubricating oil scattered in the head cover 15 and the lubricating oil leaked from the bearing of the intake-side cam shaft 30 (refer to first embodiment) are stored in the oil reservoir 151, and introduced into the casing 140 from the oil path 152 of the journal portion 61*b* under the oil level in the oil reservoir 151. The lubricating oil dripped from the journal portion 61*b* lubricates the screwed portion between the screw shaft 114 and the nut member 115. Moreover, the lubricating oil dripped to the lower portion in the casing 140 is returned from a drain hole 153 formed at the lower portion of the casing body 141 in the casing 140 to the cylinder head 14 side.

According to the second embodiment, the lubricating oil scattered in the head cover 15 and the oil leaked from the bearing of the intake-side cam shaft 30 are stored in the oil reservoir 151, and supplied to the casing 140 side by gravitation. Therefore, additional energy is not required to supply oil, and thus a power loss due to the additional energy does not occur. Moreover, it is only necessary to form the oil reservoir 151 at some of the upper holders 38, and the oil path 152 can be formed by comparatively simple drilling. Therefore, it is possible to minimize the increase of the manufacturing cost.

Though embodiments of the present invention have been described above, the present invention is not restricted to the above embodiments. It is possible to perform various design modifications without deviating from the present invention described in the claims.

For the above embodiments, a case is described in which the present invention is applied to the intake-side engine valve operating system 28 capable of changing the valve-opening lift amount of the intake valve 20 serving as an engine valve. The present invention can be widely carried out corresponding to an engine valve operating system for changing operation characteristics of an engine valve in accordance with the pivoting of a control shaft.

Moreover, instead of the power conversion means 111 and 144 of the above first and second embodiments, a sector gear meshed with a rack gear formed on the nut member 115 can be formed on a control arm. By applying a backlash removing mechanism using a publicly-known scissors gear to the meshed portion between the rack gear and the sector gear, an accurate control free of rattling can be expected. Moreover, by using a publicly-known ball nut for the nut member 115, further smooth operation and high accuracy can be expected. Furthermore, because the direction of a force applied to the tooth surface of the rack gear is constant, the power and torsional strength required for the pivoting of the control shaft 61 can be easily designed, as compared to the case of a link mechanism in which the magnitude of and direction of a force depend on a pivoting angle.

What is claimed is:

1. A drive of a variable valve lift mechanism for driving a control shaft controlling a variable valve lift mechanism provided between an engine valve and an engine valve operating cam in order to change lift amount of the engine valve comprising:

a rotational force generating actuator;

power conversion means for converting a rotational force of the rotational force generating actuator into a pivoting force of the control shaft; and a casing containing the power conversion means with the rotational force generating actuator coupled to an outer face of the casing, wherein one end of the control shaft protrudes outward from one side of an engine body, wherein the casing into which one end of the control shaft is inserted is attached to the one side of the engine body through fixing means which can be repeatedly attached and detached, and wherein a rotation of the control shaft about an axis thereof causes a change in lift amount of the engine valve.

2. The drive of a variable valve lift mechanism according to claim 1, wherein an oil reservoir surrounding the control shaft is formed on a cylinder head constituting a part of the engine body; and wherein an oil path whose one end opens at a portion immersed in the oil of the control shaft is provided on the control shaft so as to lead lubricating oil into the casing.

3. The drive of a variable valve lift mechanism according to claim 1, wherein the rotational force generating actuator has an output shaft whose axis is provided on a plane orthogonal to an axis of the control shaft, and is attached to an outer face of the casing, wherein the power conversion means is housed in the casing and includes a screw shaft having an axis parallel with the output shaft and a reduction gear mechanism provided between the screw shaft and the output shaft.

4. The drive of a variable valve lift mechanism according to claim 1, wherein a positioning section is integrally provided in a holder attached to the engine body to rotatably support at least a part of a circumference of the one end of the control shaft, and has a portion surrounding the control shaft and protruding out of a sidewall of the engine body; and wherein the casing is attached to an outer face of the sidewall of the engine body, and includes a fitting hole for receiving the portion of the positioning section protruding out of the sidewall of the engine body.

5. The drive of a variable valve lift mechanism according to claim 4, wherein the holder is attached to a cylinder head constituting a part of the engine body in cooperation with a head cover; and wherein the positioning section is held between mating faces of the cylinder head and the head cover.

6. The drive of a variable valve lift mechanism according to claim 3, wherein a sensor is coaxially arranged on the control shaft so as to detect pivoting amount of the control shaft, and is attached to a wall portion of the casing opposite to the one end of the control shaft.

7. The drive of a variable valve lift mechanism according to claim 1, wherein the power conversion means includes a control arm attached to an end of said control shaft and a screw shaft actuating said control arm.

* * * * *